US007463845B2

(12) United States Patent
Suda et al.

(10) Patent No.: US 7,463,845 B2
(45) Date of Patent: Dec. 9, 2008

(54) CHARGING DEVICE HAVING A FIRST AND SECOND PRESSURE WITH A CLEANING MEMBER, AND PROCESS CARTRIDGE AND IMAGE FORMING APPARATUS INCLUDING THE CHARGING DEVICE

(75) Inventors: Takeo Suda, Tokyo (JP); Shinichi Kawahara, Tokyo (JP); Keiichi Yoshida, Kawasaki (JP); Yoshio Hattori, Kawasaki (JP); Shuji Tanaka, Chigasaki (JP)

(73) Assignee: Ricoh Company Limited, Tokyo (JP)

( * ) Notice: Subject to any disclaimer, the term of this patent is extended or adjusted under 35 U.S.C. 154(b) by 296 days.

(21) Appl. No.: 11/220,642

(22) Filed: Sep. 8, 2005

(65) Prior Publication Data

US 2006/0067727 A1 Mar. 30, 2006

(30) Foreign Application Priority Data

Sep. 28, 2004 (JP) ..... 2004-281427

(51) Int. Cl.
*G03G 21/18* (2006.01)

(52) U.S. Cl. ..... 399/115; 399/100; 399/176

(58) Field of Classification Search ..... 399/100, 399/176, 115

See application file for complete search history.

(56) References Cited

U.S. PATENT DOCUMENTS

| | | | | |
|---|---|---|---|---|
| 6,097,914 | A | 8/2000 | Tanaka et al. | |
| 6,463,237 | B2 | 10/2002 | Suda et al. | |
| 6,539,186 | B2 * | 3/2003 | Kitazawa et al. | 399/100 |
| 6,591,077 | B2 | 7/2003 | Yanagisawa et al. | |
| 6,807,390 | B2 | 10/2004 | Suda et al. | |
| 6,826,381 | B2 | 11/2004 | Muramatsu et al. | |
| 6,889,023 | B2 | 5/2005 | Suda et al. | |
| 6,917,779 | B2 | 7/2005 | Fujimori et al. | |
| 2003/0180071 | A1 | 9/2003 | Suda | |

(Continued)

FOREIGN PATENT DOCUMENTS

| | | |
|---|---|---|
| JP | 1-207768 | 8/1989 |

(Continued)

OTHER PUBLICATIONS

U.S. Appl. No. 11/625,672, filed Jan. 22, 2007, Harada et al.

(Continued)

*Primary Examiner*—David M. Gray
*Assistant Examiner*—Ruth N Labombard
(74) *Attorney, Agent, or Firm*—Oblon, Spivak, McClelland, Maier & Neustadt, P.C.

(57) ABSTRACT

A charging device including a charging member configured to charge an image bearing member while the charging member is contacted with or is located so as to be close to the image bearing member when the charging device is set in an image forming apparatus; and a cleaning member configured to clean a surface of the charging member while contacting the surface of the charging member, wherein the pressure A at which the cleaning member is contacted with the charging member when the charging device is set in the image forming apparatus is greater than the pressure B at which the cleaning member is contacted with the charging member before the charging device is set in the image forming apparatus.

7 Claims, 19 Drawing Sheets

U.S. PATENT DOCUMENTS

| | | | | |
|---|---|---|---|---|
| 2004/0042822 | A1 | 3/2004 | Fujishiro et al. | |
| 2004/0141781 | A1 | 7/2004 | Suda | |
| 2004/0165913 | A1 | 8/2004 | Hattori | |
| 2005/0025522 | A1* | 2/2005 | Tsuzuki et al. | 399/111 |
| 2005/0191081 | A1* | 9/2005 | Muraishi et al. | 399/100 |
| 2005/0196194 | A1* | 9/2005 | Suda et al. | 399/111 |

FOREIGN PATENT DOCUMENTS

| | | |
|---|---|---|
| JP | 3-35276 | 2/1991 |
| JP | 7-199603 | 8/1995 |
| JP | 9-96945 | 4/1997 |

OTHER PUBLICATIONS

U.S. Appl. No. 11/519,919, filed Sep. 13, 2006, Tanaka et al.

* cited by examiner

CHARGING DEVICE HAVING A FIRST AND SECOND PRESSURE WITH A CLEANING MEMBER, AND PROCESS CARTRIDGE AND IMAGE FORMING APPARATUS INCLUDING THE CHARGING DEVICE

BACKGROUND OF THE INVENTION

1. Field of the Invention

The present invention relates to a charging device which charges the surface of a material, and more particularly to a charging device which includes at least a charging member and a cleaner for cleaning the charging member and which charges an image bearing member such as photoreceptors in an electrophotographic image forming apparatus such as copiers, facsimile machines and printers. In addition, the present invention also relates to an image forming apparatus and a process cartridge using a charging device.

2. Discussion of the Background

Recently, process cartridges including a unit of, for example, a photoreceptor and one or more of image forming devices such as charging devices, developing devices, and cleaning devices are broadly used for electrophotographic image forming apparatus. Even when one or more image forming devices are damaged or the lives thereof expire, the image forming apparatus can be continuously used with a short downtime by replacing the process cartridge with new one. In this case, only the replacing operation is performed, and therefore the operation time of the serviceman is very short. Alternatively, a user may perform the operation without calling a serviceman because the replacing operation is easy.

When process cartridges include a charging member and a cleaning member for cleaning the charging member which are integrated with each other as a unit while the cleaner is brought into pressure-contact with the charger, a problem in that the cleaning member is deformed when the process cartridges are preserved before use. In this case, the deformed cleaning member has poor cleaning ability.

In addition, recently toners having a small particle diameter or polymerization toners which are prepared by a polymerization method are typically used in order to produce high quality images and to save energy in the toner manufacturing process. However, these toners tend to pass through the nip between a cleaning member and a surface of a charging member, namely, the toners have poor cleaning property. Particularly, when such a deformed cleaning member as mentioned above is used, the toner passing problem is caused more frequently.

When the amount of toner particles remaining on the surface of the charging member without being removed increases due to the toner passing problem, a toner layer is formed on the charging member, thereby causing defective charging.

In attempting to solve the problem, published unexamined Japanese patent application No. (hereinafter referred to as JP-A) 07-199603 discloses an image forming apparatus in which pressing members, each including a cleaner, press a charging roller and a transfer roller to a photoreceptor via the respective cleaners, wherein the charging roller and the transfer roller are separated from the photoreceptor or are contacted with the photoreceptor by their own weights when they are not used for forming images. Since the charging roller and the transfer roller are not contacted with or are lightly contacted with the photoreceptor, a problem in that the charging roller and the transfer roller are deformed due to a strong contact pressure, which results in deterioration of image qualities, is not caused.

JP-A 01-207768 discloses an image forming apparatus which uses a contact charging device which is allowed to separate from the photoreceptor by a mechanical method when the apparatus is in a standby state (i.e., when image forming operations are not performed). In addition, JP-A 03-35276 discloses an image forming apparatus which uses a contact transferring device which is allowed to separate from the photoreceptor by a mechanical method when the apparatus is in a standby state.

However, the above-mentioned techniques are used for preventing deformation of the charging devices or the transfer devices after the devices are set in the image forming apparatus, and are not used for preventing deformation of the members when the devices are preserved (i.e., when process cartridges including the devices are not set in the image forming apparatus).

JP-A 09-96945 discloses an image forming apparatus which includes a charging device including a charging roller configured to charge a photoreceptor, a cleaning pad which is supported so as to be contacted with or separated from the charging roller, and a means for moving the cleaning pad such that the portion of the cleaning pad contacted with the charging roller is changed, wherein the photoreceptor drives the contact portion moving means to move without providing a special driving means. By moving the cleaning pad, the contact portion is changed and thereby the above-mentioned deformation problem can be avoided. Although this technique is intended to miniaturize the image forming apparatus by not providing a special driving means, the image forming apparatus has a complicated structure and therefore the image forming apparatus cannot be miniaturized.

Because of these reasons, a need exists for a charging device which can be used for a long period of time without causing the deformation problem even when the charging device is preserved for a long period of time while incorporated in a process cartridge.

SUMMARY OF THE INVENTION

Accordingly, an object of the present invention is to provide a charging device which can be used for a long period of time without causing the deformation problem even when the charging device is preserved for a long period of time while incorporated in a process cartridge.

Another object of the present invention is to provide an image forming apparatus and a process cartridge, which can produce high quality images for a long period of time without causing a charging problem even when a toner having a small particle diameter or a polymerization toner is used.

Briefly these objects and other objects of the present invention as hereinafter will become more readily apparent can be attained by a charging device including:

a charging member configured to charge an image bearing member of an image forming apparatus while the charging member is contacted with or is located so as to be close to the image bearing member when the charging device is set in the image forming apparatus; and a cleaning member configured to clean a surface of the charging member while contacting the surface of the charging member, wherein the charging device satisfies the following relationship:

$$A>B,$$

wherein A represents a pressure at which the cleaning member is contacted with the charging member when the charging device is set in the image forming apparatus, and B represents a pressure at which the cleaner is contacted with the charging roller before the charging device is set in the image forming apparatus.

It is preferable that the charging device further includes a first pressing member configured to press the charging member to the image bearing member and a second pressing member configured to press the cleaning member to the charging member, wherein the pressure B is maintained to be substantially constant by the second pressing member.

The cleaning member is preferably rotated while driven by the charging member. In addition, the cleaning member preferably includes a foamed material and/or a fibrous material.

As another aspect of the present invention, a process cartridge is provided which includes at least an image bearing member and a charging device configured to charge a surface of the image bearing member, wherein the charging device is the charging device mentioned above.

As yet another aspect of the present invention, an image forming apparatus is provided which includes:

an image bearing member;

a charging device configured to charge a surface of the image bearing member;

a light irradiating device configured to irradiate the charged image bearing member with imagewise light to form an electrostatic latent image on the image bearing member;

a developing device configured to develop the electrostatic latent image with a developer including a toner to form a toner image on the image bearing member;

a transferring device configured to transfer the toner image to a receiving material; and a cleaning device configured to clean the surface of the image bearing member, wherein the charging device is the charging device mentioned above.

The image forming apparatus can include the process cartridge mentioned above.

The toner preferably has a volume-average particle diameter (Dv) not greater than 10 μm and a ratio (Dv/Dn), which is a ratio of the volume-average particle diameter (Dv) of the toner to the number average particle diameter (Dn) of the toner, of from 1.00 to 1.40. In addition, the toner preferably has a first shape factor SF-1 of from 100 to 180 and a second shape factor SF-2 of from 100 to 180. Further, the toner is preferably a polymerization toner prepared by a method including:

dispersing or dissolving a toner composition including at least a polyester prepolymer having a nitrogen-containing group, a polyester resin, a colorant, and a release agent in an organic solvent to prepare a toner composition liquid; and subjecting the toner composition liquid to a crosslinking reaction and/or a molecular chain extension reaction in an aqueous medium.

These and other objects, features and advantages of the present invention will become apparent upon consideration of the following description of the preferred embodiments of the present invention taken in conjunction with the accompanying drawings.

DETAILED DESCRIPTION OF THE INVENTION

At first, the image forming apparatus and process cartridge of the present invention will be explained referring to several embodiments and drawings. The present invention is not limited to the embodiments.

Figure 1:
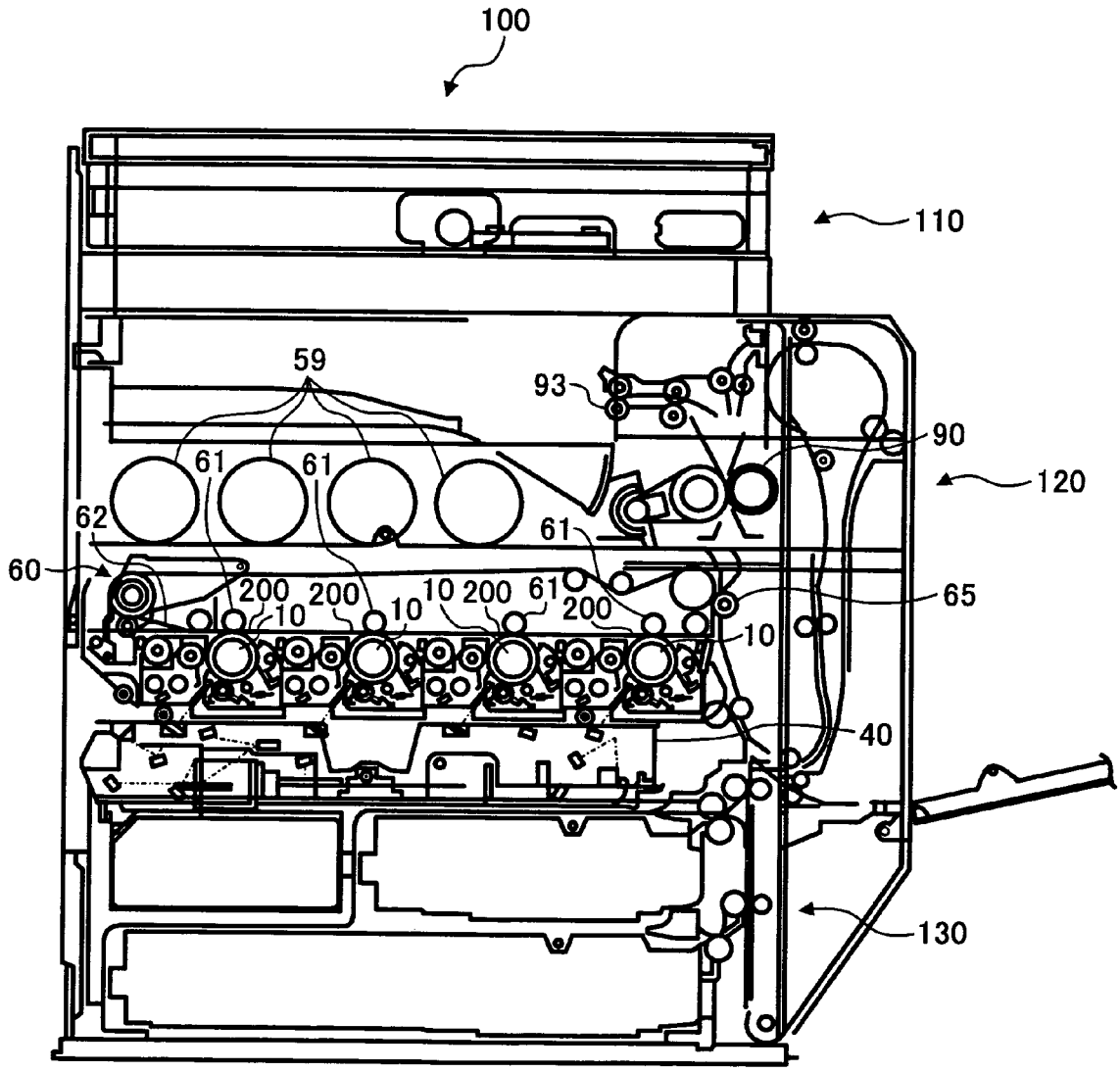
FIG. 1 is a schematic view illustrating an embodiment of the image forming apparatus of the present invention.
Figure 2:
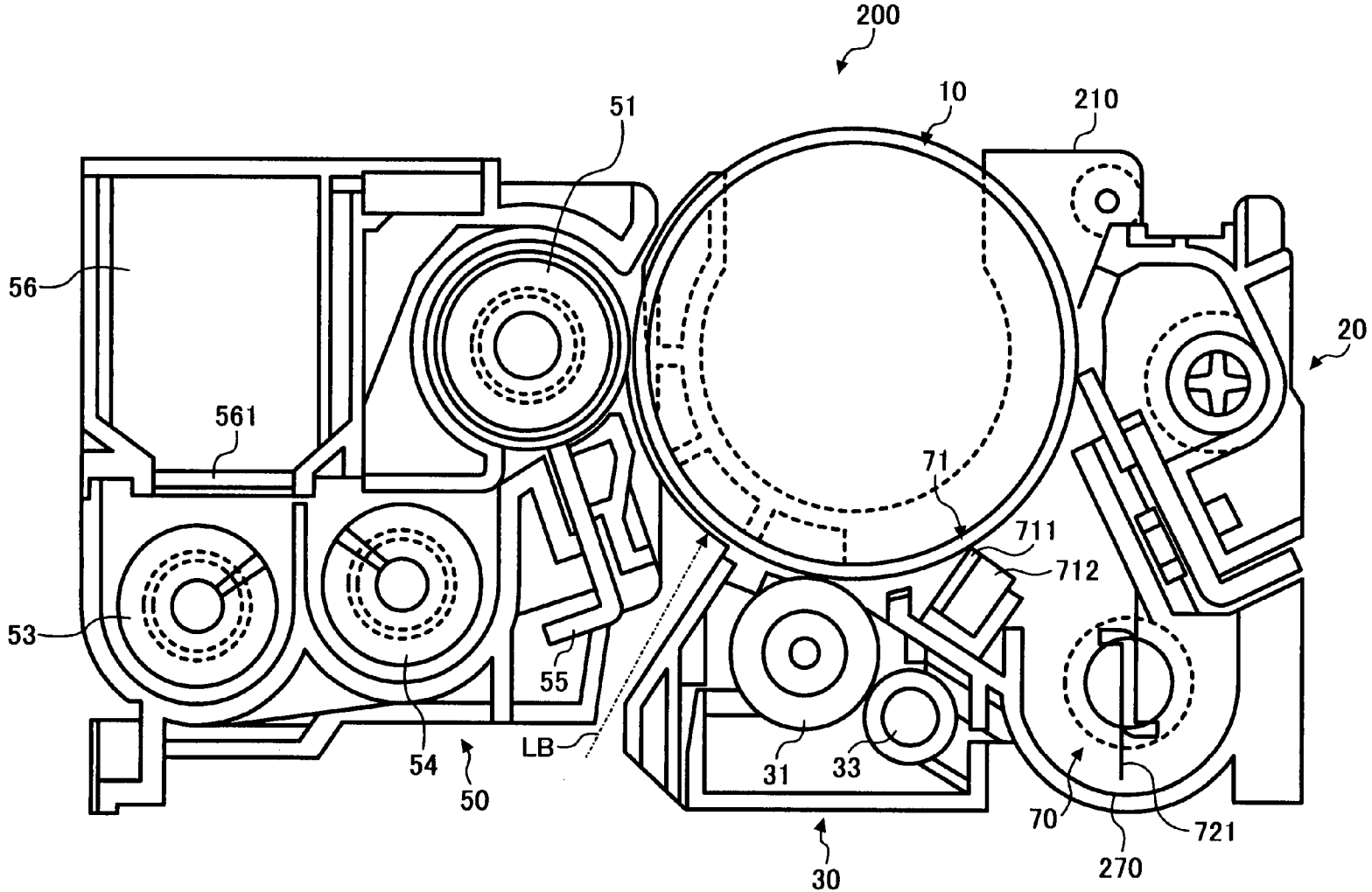
FIG. 2 is a schematic view illustrating an embodiment of the process cartridge of the present invention.

FIG. 1 is a schematic view illustrating the cross section of an embodiment of the image forming apparatus, which can produce full color images. FIG. 2 is a schematic view illustrating the cross section of an embodiment of the process cartridge of the present invention. Referring to FIG. 1, an image forming apparatus 100 includes an image reading section 110, an image forming section 120, and a paper feeding section 130. The image forming section 120 includes four process cartridges 200 (for yellow, cyan, magenta and black colors) which are arranged in parallel in the main body of the image forming apparatus 100; a transfer device 60 including an endless intermediate transfer belt 62 and a secondary transfer roller 65; and toner bottles 59 from which yellow, cyan, magenta and black color toners are fed to the respective process cartridges. As illustrated in FIG. 2, each of the process cartridges 200 includes a photoreceptor 10 serving as an image bearing member, a cleaning module 20 serving as a cleaning device, a charging module 30 serving as a charging device, a developing module 50 serving as a developing device, etc.

Referring back to FIG. 1, the intermediate transfer belt 62 is located above the photoreceptors 10, and the lower portion of the intermediate transfer belt 62 is contacted with the surface of the photoreceptor 10. Different color toner images formed on the photoreceptors 10 are transferred onto the intermediate transfer belt 62 to form a full color toner image. The image forming operation is the same in all the process cartridges 200 except that the color of the toner used therefor is different.

Referring to FIG. 2, each process cartridge 200 includes a frame 210, the photoreceptor 10, and the charging module 30. The process cartridge of the present invention is characterized by including a frame and at least an image bearing member and a charging device.

Figure 3A:
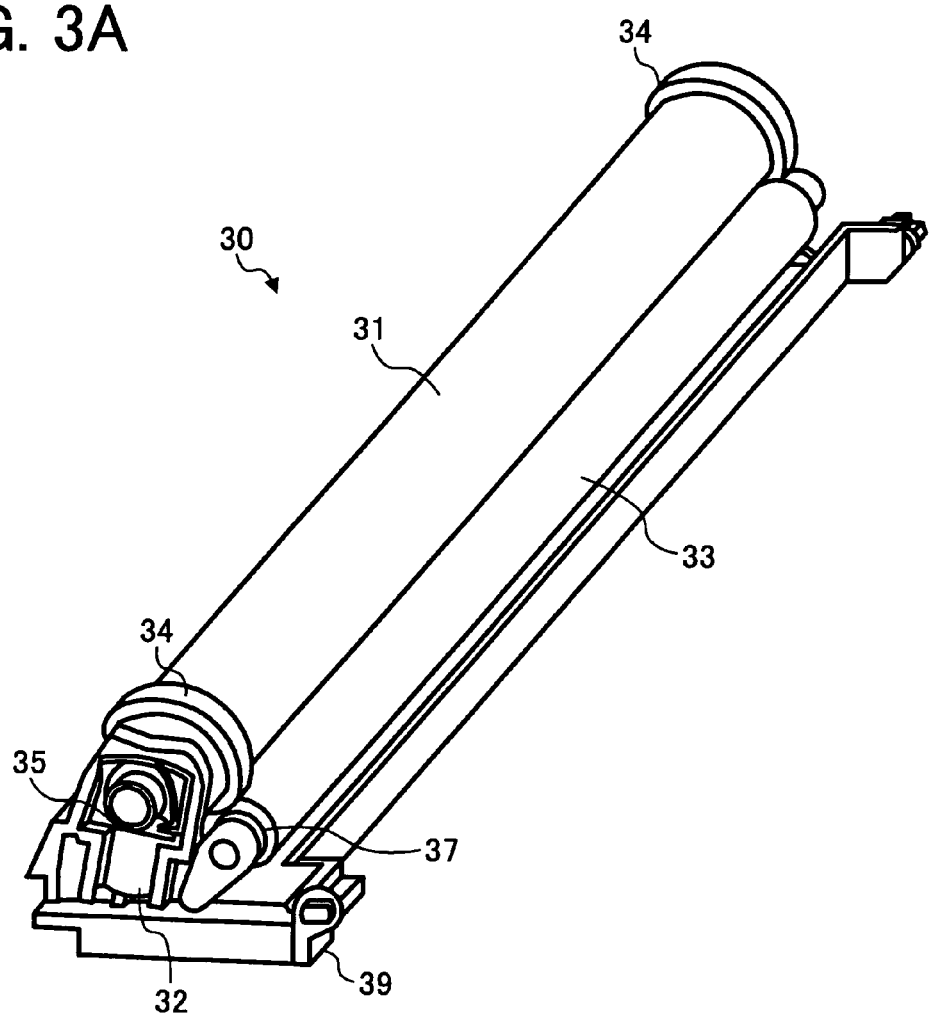
FIGS. 3A and 3B are a perspective view and a side view illustrating a charging module for use in the process cartridge of the present invention.
Figure 3B:
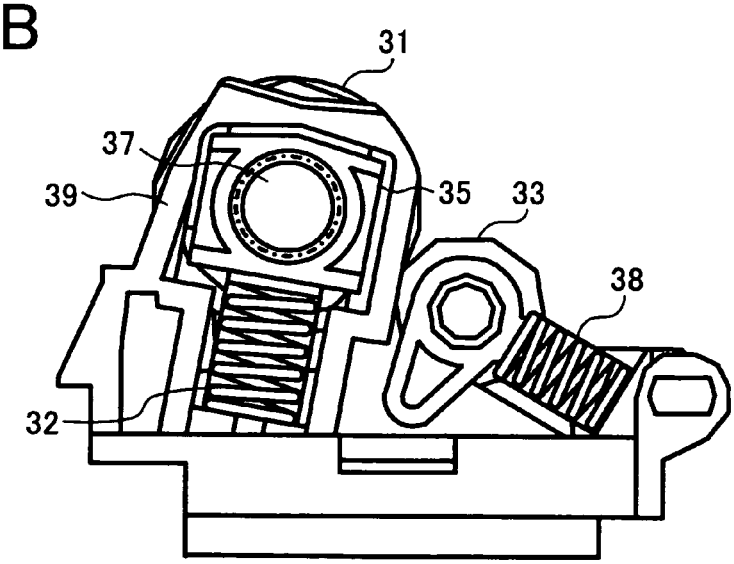

The charging module 30 is a unit in which a charging roller 31, a charger cleaning member 33, springs 32 and 38, spacers 34, a housing 39, etc., are integrated as illustrated in FIGS. 3A and 3B.

The photoreceptor 10 is rotated clockwise in FIG. 2. The photoreceptor 10 is charged so as to have a predetermined potential with a predetermined polarity by the charging roller 31, to which a predetermined voltage is applied. Then a laser beam (LB), which is optically modulated and which is emitted by an optical writing device 40, irradiates the charged photoreceptor 10, resulting in formation of an electrostatic latent image on the photoreceptor 10. The thus prepared electrostatic latent image is developed with the developing module 50 using a color toner, resulting in formation of a color toner image on the photoreceptor 10.

A primary transfer roller 61 is arranged while opposing the photoreceptor 10 with the intermediate transfer belt 62 therebetween. By applying a transfer bias to the primary transfer roller 61, the toner image on the photoreceptor 10 is primarily transferred to the intermediate transfer belt 62. Toner particles remaining on the surface of the photoreceptor 10 even after the image transfer process are removed by the cleaning module 20. A lubricant applicator 70 is provided to apply a lubricant to the surface of the photoreceptor 10 to reduce the abrasion loss of the surface of the photoreceptor and to impart good cleanability to the surface of the photoreceptor 10.

As illustrated in FIG. 1, the paper feeding device 130 which is located at a lower portion of the main body of the image forming apparatus 100 is configured to contain and feed a receiving material such as paper sheets. An uppermost sheet of the receiving material contained in one of paper cassettes is timely fed to a nip between the intermediate transfer belt 62 and the secondary transfer roller 65, which is set so as to oppose the intermediate transfer belt. In this case, a predetermined bias is applied from a power source (not shown) to the secondary transfer roller 65, and thereby the full color toner image formed on the intermediate transfer belt 62 is secondarily transferred to the receiving material.

The receiving material bearing the full color toner image thereon is fed to a fixing device 90. The toner image is fixed upon application of heat and pressure in the fixing device 90. Then the receiving material bearing the fixed toner image is then discharged to a tray, which is located at an upper potion of the image forming apparatus, by a pair of discharging rollers.

Since the image forming devices are thus unitized as a process cartridge as illustrated in FIG. 2, even in a case where one or more image forming devices are damaged or the lives thereof expire, the image forming apparatus can be continuously used with a short downtime by replacing the process cartridge with new one. Namely, the maintenance operation can be easily performed on the image forming apparatus in a short period of time.

In this embodiment, the process cartridge 200 includes a cleaning device, a charging device, a developing device, etc., each of which is unitized as a module. Therefore, if one of the modules is damaged, the process cartridge can be recovered by replacing only the damaged module with new one. By using this method, the other modules which can be used need not be disposed of, resulting in resource protection. Needless to say, users or servicemen can have an option of replacing the process cartridge with new one, for example, when the defective module is not specified.

Then the charging device of the present invention will be explained in detail. FIGS. 3A and 3B illustrate the charging module 30 serving as the charging device. As illustrated in FIG. 3, the charging module 30 includes the charging member 31 (hereinafter sometimes referred to as a charging roller) which is arranged so as to oppose the photoreceptor 10; a gear (not shown) which is set at an end portion of the charging roller 31; the spring 32 configured to prevent the charging member 31 from vibrating; the charger cleaning member 33 (hereinafter sometimes referred to as a charger cleaning roller) configured to clean the surface of the charging roller 31; a bearing 37 of the charger cleaning roller 33; the spring 38 configured to press the charger cleaning roller 33 toward the charging roller 31; the spacers 34 configured to form a gap between the photoreceptor 10 and the charging roller 33; a support 35 which is provided at an end of the charging roller 31 and which is configured to fix the charging roller 31 to the housing 39; and the housing 39 supporting the above-mentioned members.

The gear of the charging roller 31 is rotated by a driving mechanism which will be explained later, and thereby the charger cleaning roller 33 is rotatably supported while driven by the charging roller 31. The support 35 is pressed by the spring 32 in such a direction as to be separated from the housing 39 (i.e., in such a direction as to approach the shaft of the photoreceptor 10). Movement of the support 35 is regulated by a regulation member provided on the housing 39. Due to the configuration of the process cartridge, when the charging module 30 is set in the process cartridge 200, the charging roller 31 can be set such that the photoreceptor 10 is separated from the charging roller 31 with a predetermined gap which is formed by the spacers 34 while the charging roller 31 is pressed toward the photoreceptor 10. The charging module 30 can be detached from the process cartridge by itself.

In this embodiment, the charging roller 31 is rotated by a driving mechanism. However, the charging roller may be rotated while driven by the photoreceptor 10 which is rotated by a driving mechanism.

Figure 4:
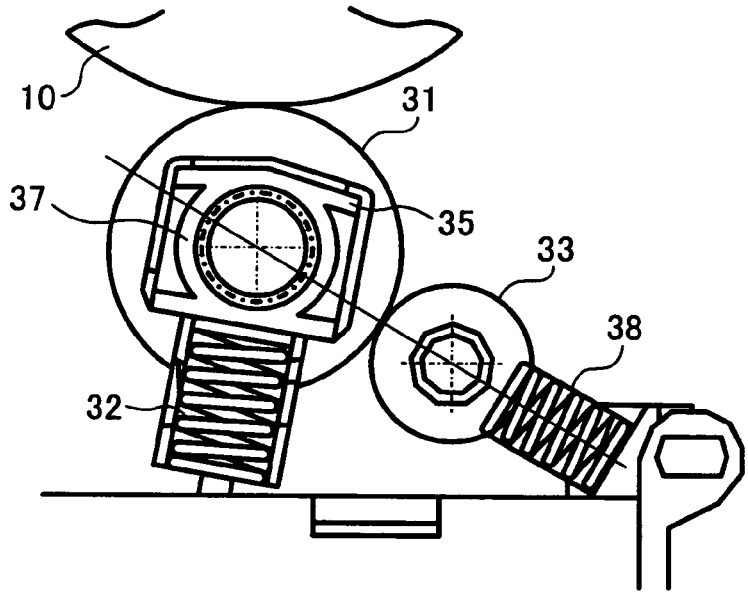
FIG. 4 is a schematic view illustrating how the members in the charging module are pressed by springs after the charging module is set to the process cartridge.
Figure 5A:
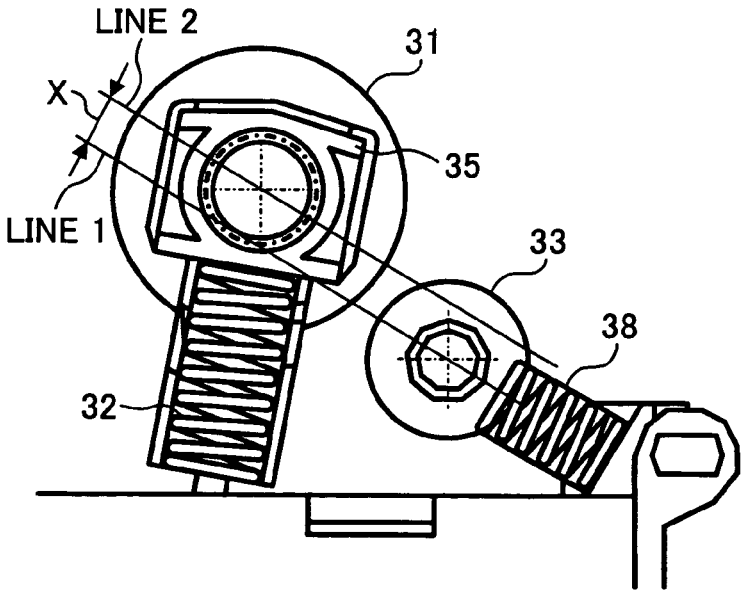
FIGS. 5A and 5B are schematic views illustrating how the members in the charging module are pressed by springs before the charging module is set to the process cartridge.
Figure 5B:
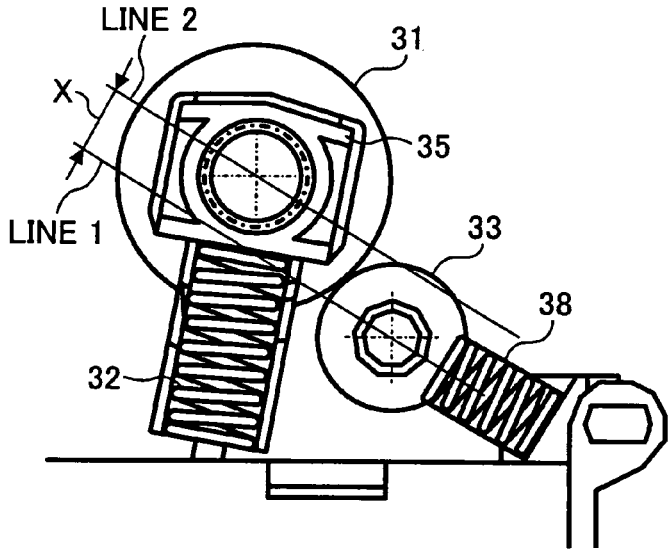

FIG. 4 illustrates the charging module 30 which has been set in the process cartridge 200 and which is pressed by the springs 32 and 38. FIGS. 5A and 5B illustrate how the charging roller 31 and the charger cleaning roller 33 are pressed by the springs 32 and 38 before the charging module 30 is set to a process cartridge.

When the charger cleaning roller 33 is made of a deformable material and a high pressure is applied thereto in the charging module 30, the charger cleaning roller 33 has a compression strain when the charging module 30 is preserved (i.e., before the charging module 30 is set in the image forming apparatus 100). In this case, the cleaning ability of the charger cleaning roller 33 deteriorates because the deformed portion of the charger cleaning roller 33 is contacted with the charging roller 31 at a low pressure. When such a charging module is used as a replaceable unit, the deformation problem tends to occur if the charging module is preserved for a long period of time.

In the charging module 30, as illustrated in FIG. 5A, the direction of the charger cleaning roller 33 pressed by the spring 38 (i.e., a line 1) is different from the center (i.e., a line 2) of the charging roller 31, which is pressed by the spring 32, by a distance X. Namely, the charger cleaning roller 33 is not contacted with the charging roller 3 (as illustrated in FIG. 5A or is lightly contacted with the charging roller 31 (as illustrated in FIG. 5B). Therefore, a deformation problem in that the charger cleaning roller 33 is deformed by the charging roller 31 can be avoided before the charging module 30 is set in an image forming apparatus (or a process cartridge). As mentioned above, the charger cleaning roller 33 may be lightly contacted with the charging roller 31 as illustrated in FIG. 5B. In this case, the same effect as that in the above-mentioned case can be produced.

Thus, the charging module 30 for use in the process cartridge and image forming apparatus of the present invention has a constitution such that the pressure that the charger cleaning roller 33 receives from the charging roller 31 before the module 30 is set in the process cartridge and the image forming apparatus 100 is lower than that after the charging module 30 is set in the image forming apparatus 100. Therefore, the deformation of the charger cleaning roller 33 can be avoided even when the module 30 is preserved for a long period of time.

After the module 30 is set in the process cartridge and the image forming apparatus 100, the charging roller 31 is pressed by the photoreceptor 10 in such a direction that the spring 32 is compressed. Therefore, the charger cleaning roller 33 is pressed by the spring 38 toward the center of the charging roller as illustrated in FIG. 4. Namely, the charging roller 31 and the charger cleaning roller 33 have a configuration such that the lines 1 and 2 (illustrated in FIGS. 5A and 5B) are overlapped with each other. Therefore, the charger cleaning roller 33 is contacted with the charging roller 31 at a proper pressure, and thereby the surface of the charging roller 31 can be well cleaned by the charger cleaning roller 33.

As illustrated in FIGS. 3 and 4, the charging device for use in the process cartridge of the present invention has a configuration such that the charger cleaning roller 33 is rotated while driven by the rotated charging roller 31. If the charger cleaning roller 33 is largely deformed, the charger cleaning roller 33 cannot be well driven by the charging roller 31. However, since deformation of the charger cleaning roller 33 can be avoided in the above-mentioned charging device for use in the process cartridge of the present invention, the charger cleaning roller 33 can be well driven by the charging roller 31 even when a special driving mechanism is not provided.

Figure 6:
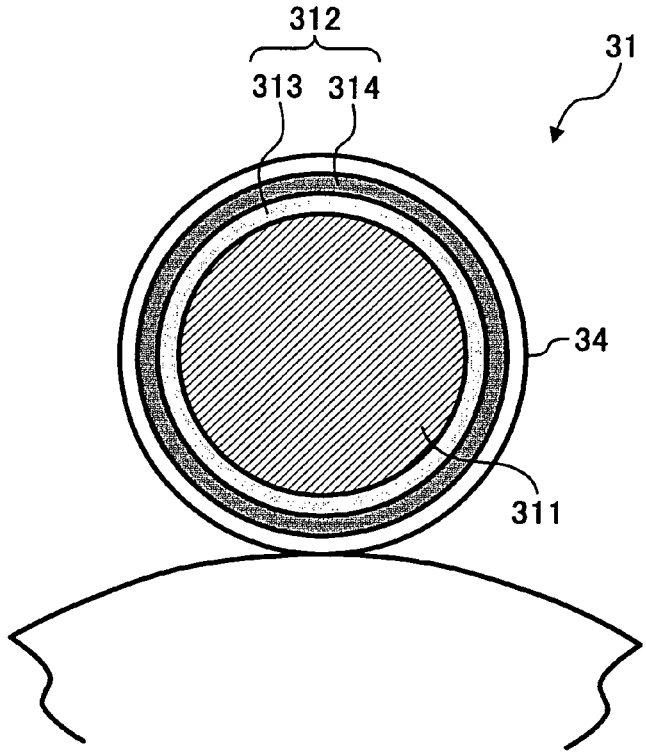
FIG. 6 is a schematic view illustrating the cross section of a charging member for use in the charging device of the present invention.

FIG. 6 illustrates the cross section of an embodiment (the charging roller 31) of the charging member for use in the charging module 30. The charging member for use in the charging module 30 is not limited thereto, but a roller is preferably used as the charging member. In FIG. 6, the charging roller 31 includes a shaft 311 which is made of a metal, a resin or the like, and a main body 312 including a layer 313 having a medium resistance, and an outermost layer 314. It is preferable that the shaft 311 has a diameter of from 8 to 20 mm and is made of a metal (such as stainless steels and aluminum) which has a high stiffness and high electroconductivity or an electroconductive resin which has a high stiffness and a volume resistivity not greater than $1\times10^{3}$ Ω·cm and preferably not greater than $1\times10^{2}$ Ω·cm. It is preferable that the layer 313 has a volume resistivity of from $1\times10^{5}$ Ω·cm to $1\times10^{9}$ Ω·cm and a thickness of from 1 to 2 mm. In addition, it is preferable that the outermost layer 314 has a volume resistivity of from $1\times10^{6}$ Ω·cm to $1\times10^{12}$ Ω·cm and a thickness of about 10 μm. In this case, the volume resistivity of the outermost layer 314 is preferably higher than that of the layer 313. The structure of the main body 312 of the charging roller 31 is not limited to the double layer structure, and the main body may have a single layer structure or a multi-layer structure including three or more layers.

Suitable materials for use in the charger cleaning roller 33 include foamed resins such as foamed melamine resins and fibrous materials. Cleaning rollers made of a foamed resin or a fibrous material have good cleanability and good corotating property (i.e., a property so as to be well driven by a roller), but have such a drawback as to easily cause compression strain. In particular, rollers made of a fibrous material tend to cause a problem in that the fibers constituting the material are bent. However, since the charging module 30 has the above-mentioned configuration, such a problem is not caused even when such materials are used for the charger cleaning roller 33.

In this embodiment, the charger cleaning roller 33 is made of a foamed resin. However, the material is not limited thereto, and various brushes and rollers can be used therefor.

As illustrated in FIGS. 3A and 6, the spacers 34 are provided on both ends of the charging roller 31. The gap between the charging roller 31 and the photoreceptor 10 is preferably controlled by the spacer 34 so as to be not greater than 100 μm and preferably from 20 to 50 μm. By using such a charging roller, formation of undesired images due to abnormal charging can be prevented. The gap may be formed and controlled by engaging the charging module 30 with an engaging portion formed on the frame 210 of the process cartridge 200. In addition, the charging roller 31 is pressed to the surface of the photoreceptor 10 by the spring 32 provided in a bearing made of a resin having a low friction coefficient, and thereby a uniform gap is formed even when the charging roller 31 is vibrated or the shaft 311 is decentered.

The charging device (i.e., the charging module 30) of the present invention can be detachably attached to the case of the process cartridge 200 which includes the photoreceptor 10. In order to improve the assembling property of the process cartridge, it is preferably to unitize the image forming devices such as charging devices, cleaning devices, etc., so that the image forming devices can be easily attached to and detached from the process cartridge. In this case, it is necessary for the units to have a configuration such that the constitutional members do not cause the deformation problem.

As mentioned above, the charging device of the present invention has a configuration such that the pressure applied to the charging roller 31 and the charger cleaning roller 33 is lowered or is reduced to zero before the charging device is set in an image forming apparatus (i.e., when the charging device is preserved by itself). Therefore, even if the charging device is assembled and preserved for a long period of time, the charging unit does not cause the deformation problem.

Figure 7:
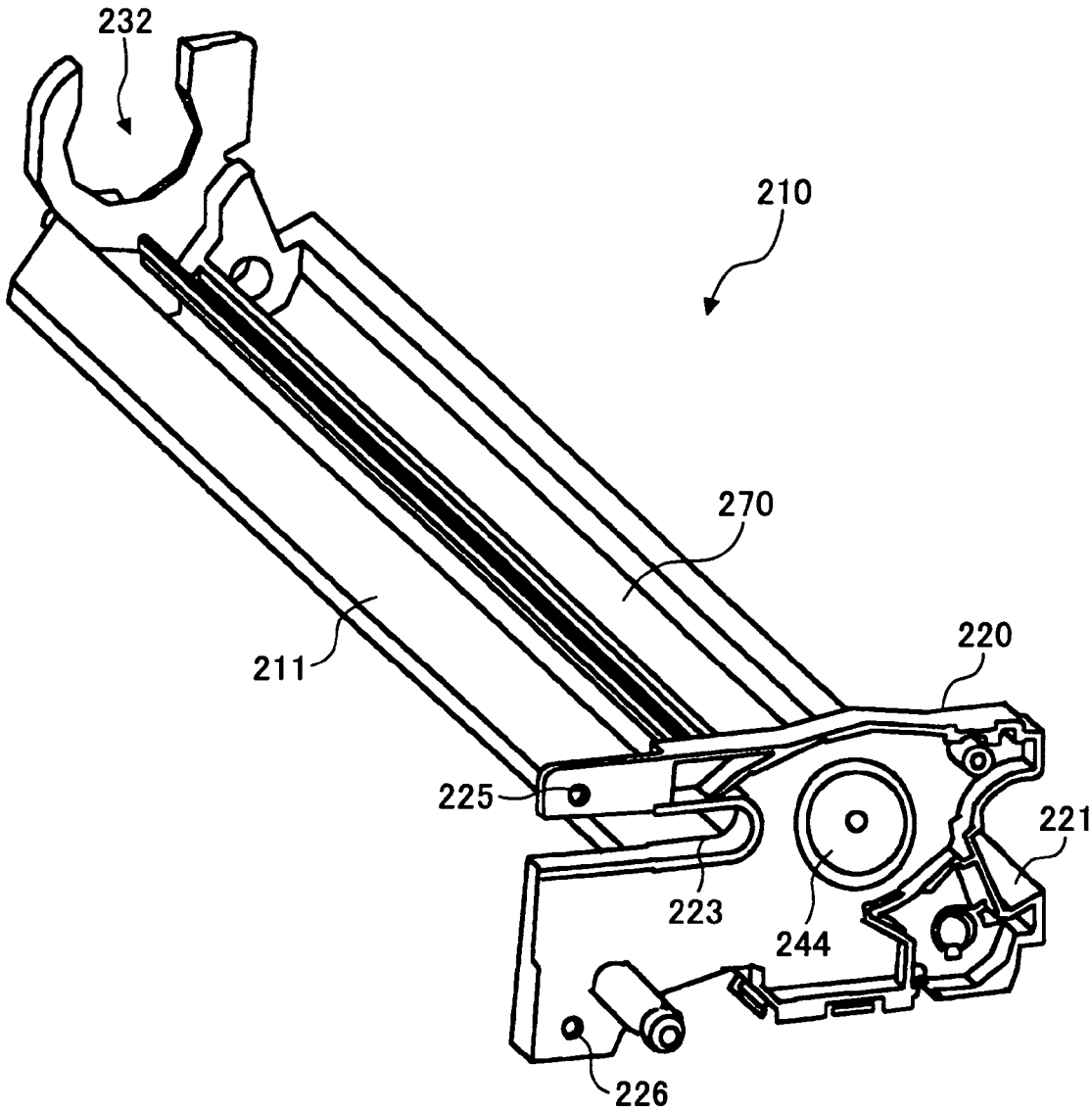
FIG. 7 is a schematic view illustrating a frame for use in the process cartridge of the present invention.

FIG. 7 illustrates the frame 210 of the process cartridge 200. The frame 210 includes a first side plate 220, a positioning plate 211 configured to position the charging module 30 in the process cartridge 200, and a lubricant containing portion 270 configured to contain therein the lubricant applicator 70 and a lubricant powder. The first side plate 220 includes a bearing 244 configured to receive a rotation shaft 14 of the photoreceptor 10, which extends from a flange 13 of the photoreceptor (the rotation shaft and flange are illustrated in FIG. 9); a guide groove 223 configured to receive the developing module 50; and holes 225 and 226 for fixing the developing module 50. On the side of the frame 210 opposite to the first side plate 220, a provisional photoreceptor setting portion 232 is provided. When the rotation shaft 14 of the photoreceptor 10 is set on a second side plate 250 (illustrated in FIG. 8) of the process cartridge in the assembling process, the photoreceptor 10 is provisionally set on the provisional photoreceptor setting portion 232. In addition, the side plate 220 includes a first contact portion 221 at which the side plate 220 is contacted with a support plate 21 (illustrated in FIG. 11A) of a cleaning device, which is mentioned later.

Figure 8:
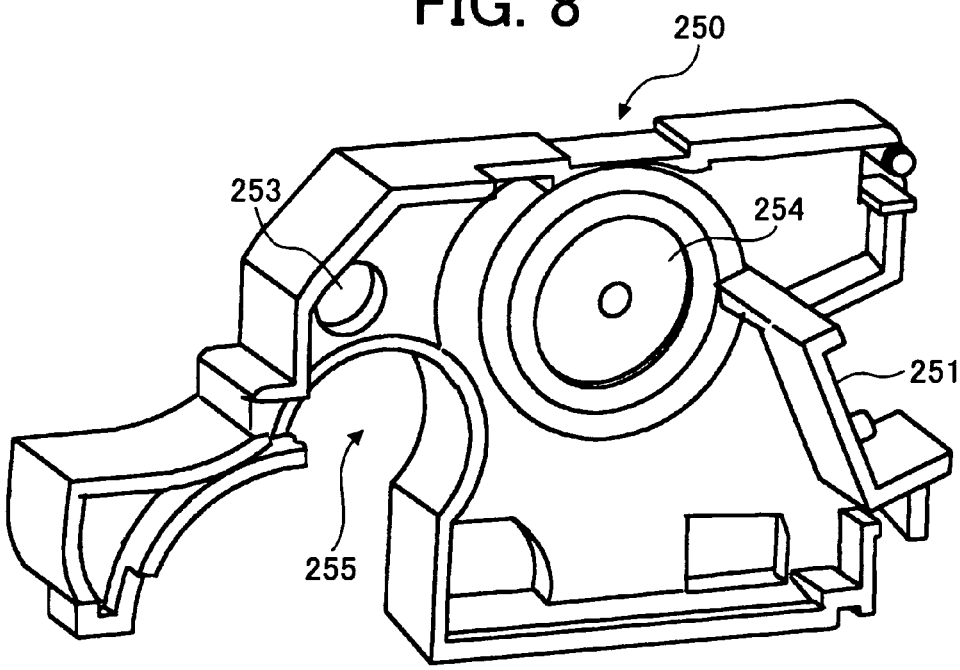
FIG. 8 is a schematic view illustrating a side plate for use in the process cartridge of the present invention.
Figure 9:
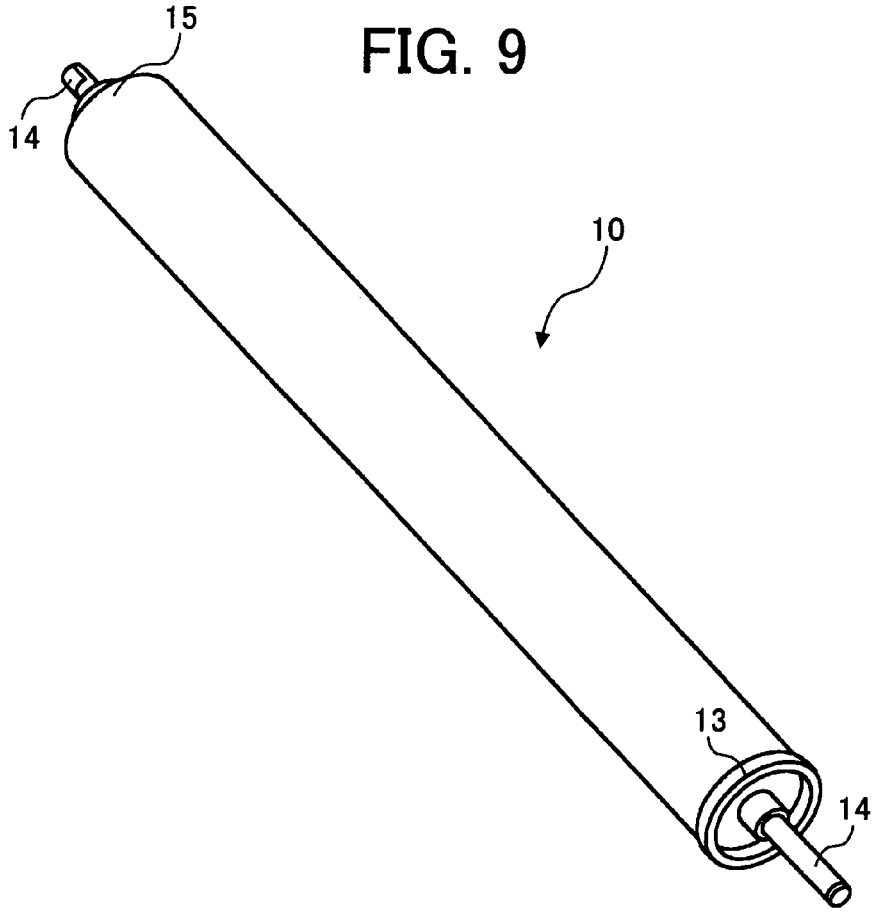
FIG. 9 is a schematic view illustrating a photoreceptor for use in the process cartridge of the present invention.

FIG. 8 illustrates the second side plate 250 of the process cartridge 200. The second side plate 250 includes a second contact portion 251 which receives the support plate 21 of the cleaning module 20, a bearing 254 through which the rotation shaft 14 is introduced, a shaft supporting portion 253 through which a shaft of a developing sleeve 51 is introduced, and a guide groove 255 configured to guide a developer supplying roller 54. The contact angle of the support plate 21 of the cleaning module 20 against the photoreceptor 10 is determined depending on the first contact portion 221 and the second contact portion 251.

FIG. 9 illustrates the photoreceptor 10 for use in the process cartridge 200 of the present invention.

The photoreceptor 10 has a cylindrical form and includes flanges 13 and 15 provided on the respective end portions and the rotation shaft 14, which is introduced through the flanges 13 and 15.

Figure 10:
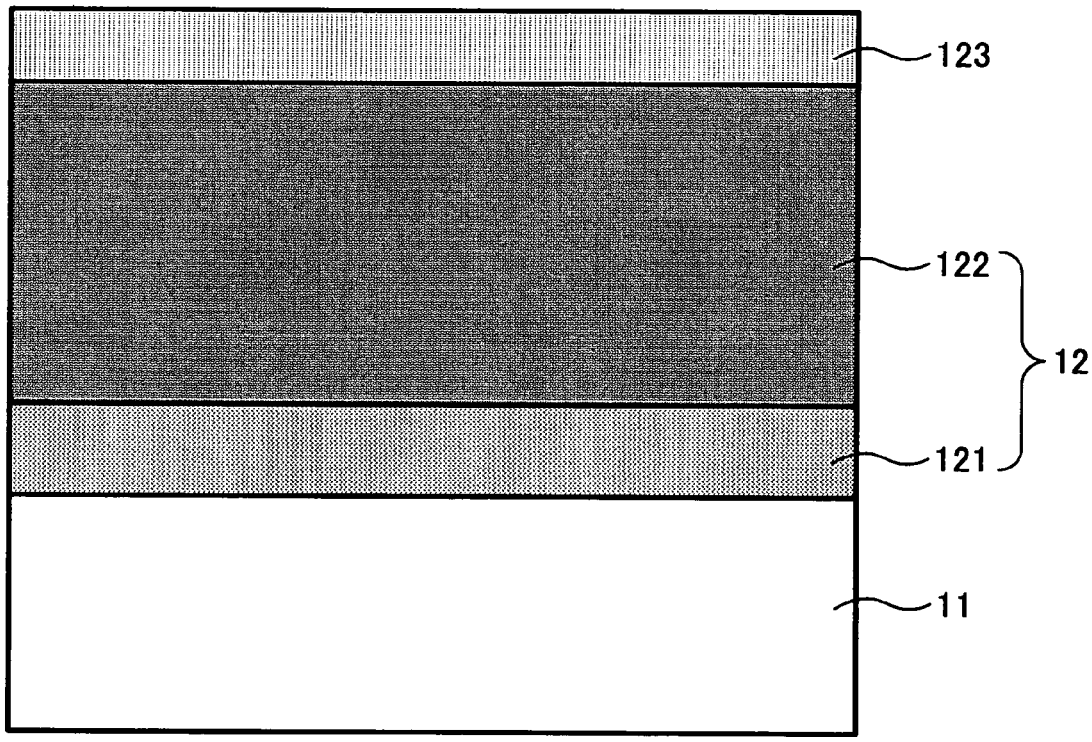
FIG. 10 is a schematic view illustrating the cross section of a photoreceptor for use in the process cartridge of the present invention.

FIG. 10 illustrates the cross section of an embodiment of the photoreceptor 10. As illustrated in FIG. 10, the photoreceptor 10 includes a substrate 11 and a photosensitive layer 12 located on the aluminum substrate 11. Suitable materials for use as the substrate 11 include metal cylinders which are prepared by tubing a metal such as aluminum, copper, iron and their alloys by a method such as impact ironing or direct ironing, and then subjecting the surface of the resultant tube to cutting, super finishing, polishing and the like treatments.

The photosensitive layer 12 typically includes a charge generation layer 121 including a charge generation material as a main component, and a charge transport layer 122 configured to transport the generated charges to the surface of the photoreceptor or the substrate 11. The charge generation layer 121 is typically prepared by coating a coating liquid on the substrate 11 and then-drying the coated liquid. The coating liquid is typically prepared by dispersing a charge generation material in an organic solvent optionally together with a binder resin using a dispersion machine such as ball mills, attritors, sand mills and ultrasonic dispersion machines. Any known charge generation materials such as monoazo pigments, disazo pigments, trisazo pigments, perylene pigments, perynone pigments, quinacridone pigments, quinone based condensed polycyclic compounds, squaric dyes, phthalocyanine pigments, naphthalocyanine pigments, and azulenium pigments can be used for the charge generation layer 121. Among these pigments, azo pigments and phthalocyanine pigments are preferably used.

The charge transport layer 122 is typically prepared by the following method:

(1) a coating liquid is prepared by dissolving or dispersing a charge transport material and a binder resin, optionally together with additives such as plasticizers and leveling agents, in a proper solvent; and (2) the coating liquid is coated on the charge generation layer, followed by drying to prepare the charge transport layer.

Any known charge transfer materials can be used for the charge transport layer 122.

Charge transport materials are classified into positive-hole transport materials and electron transport materials.

Specific examples of the electron transport materials include electron accepting materials such as chloranil, bromanil, and tetracyanoethylene. Specific examples of the positive hole transport materials include poly-N-vinylcarbazole and derivatives thereof, poly-γ-carbazolylethylglutamate, and derivatives thereof, pyrene-formaldehyde condensation products and derivatives thereof, polyvinylpyrene, polyvinylphenanthrene, etc.

In addition, a protective layer 123 may be formed on the photosensitive layer 12 to protect the photosensitive layer 12. The protective layer 123 preferably includes a filler to improve the abrasion resistance of the photoreceptor. Inorganic materials are preferably used as the filler in view of hardness. Among the inorganic materials, silica, titanium oxide and alumina are preferably used.

Figure 11A:
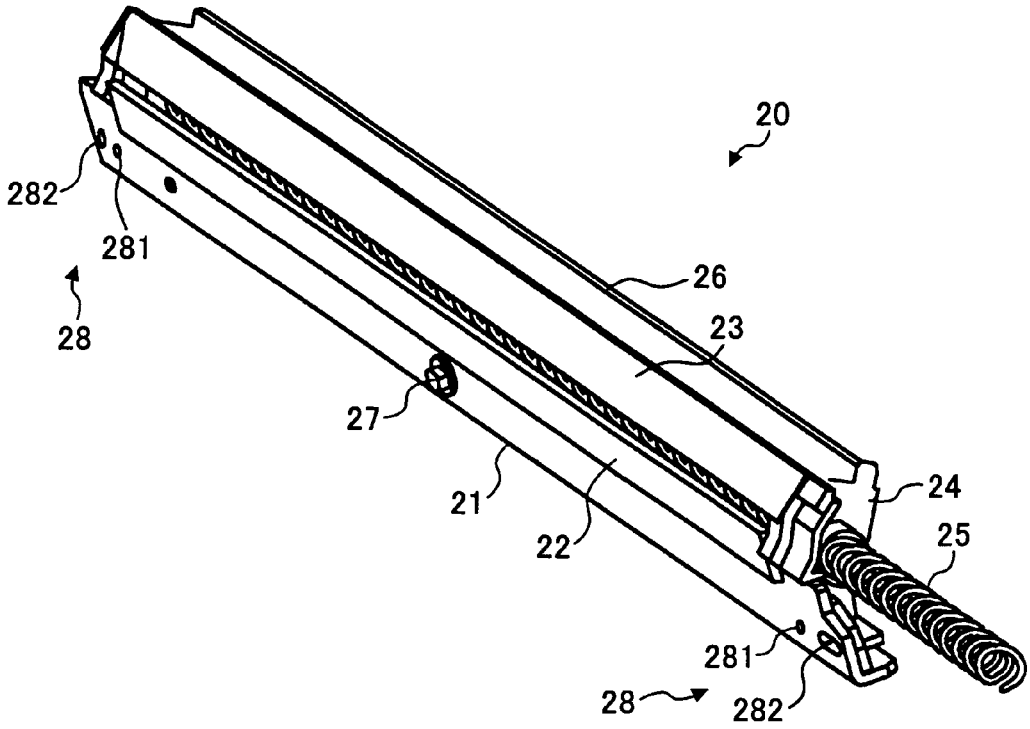
FIGS. 11A and 11B are a perspective view and a cross sectional view illustrating a cleaning module for use in the process cartridge of the present invention.
Figure 11B:
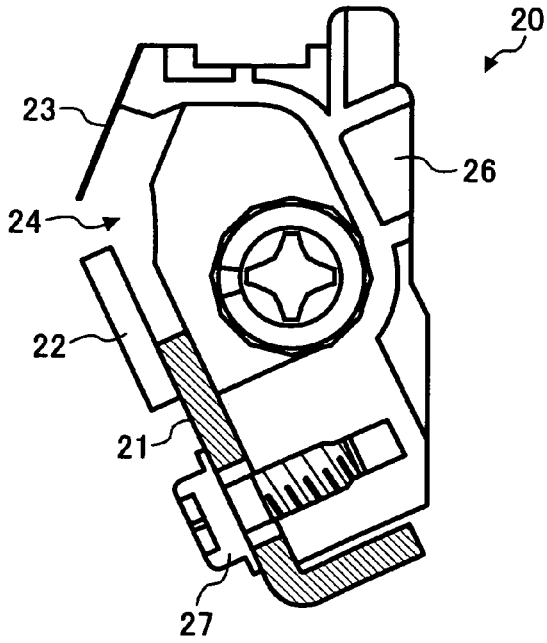

FIGS. 11A and 11B are a perspective view and a cross sectional view illustrating the cleaning module 20 for use in the process cartridge of the present invention.

Referring to FIGS. 11A and 11B, the cleaning module 20 includes a cleaning blade 22 serving as a cleaning member, the support plate 21 configured to support the cleaning blade 22, a housing 26 configured to contain toner particles collected from the photoreceptor 10, an entrance seal 23 configured to seal the housing 26 so that the collected toner particles do not scatter, and a feeding auger 25 configured to feed the toner particles in the housing 26 to the main body of the image forming apparatus 100. The support plate 21 is fixed to the housing 26 with a screw 27 at substantially a midpoint in the longitudinal direction of the support plate 21. Numeral 24 denotes a collected toner containing portion.

A positioning guide 28 is provided on each end portion of the support plate 21. The positioning guide 28 includes a hole 281 which receives a positioning pin of the contact portion 221 or 251, and another hole 282 which receives a fixing screw for fixing the cleaning module to the first and second side plates 220 and 250. The positioning method is not limited thereto, and a method in which an elastic material is pressed to a hole or a recessed portion can also be used. In addition, the fixing method is not limited to the above-mentioned method, and a method using a combination of a rod-shaped projection and an E-form retaining ring can also be used.

Figure 12A:
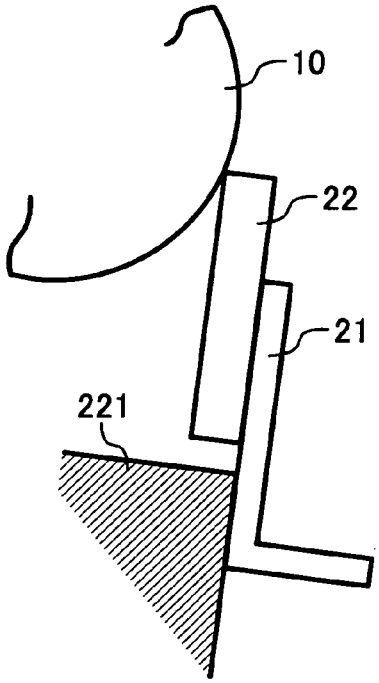
FIGS. 12A and 12B are schematic views illustrating cleaning blades for use in the cleaning module.
Figure 12B:
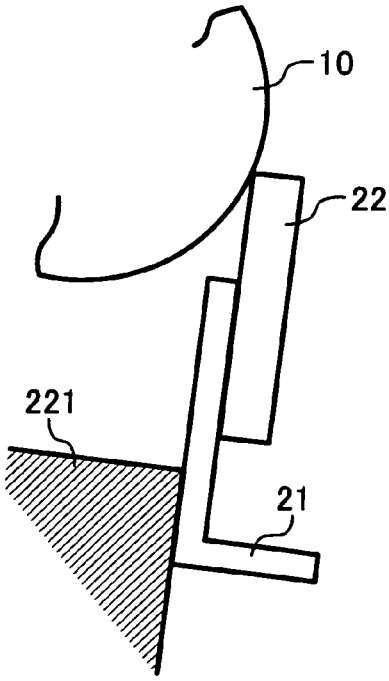

FIGS. 12A and 12B are schematic views illustrating examples of configuration of the cleaning blade 22 in the cleaning module 20. The cleaning blade 22 illustrated in FIG. 12A is set on the side of the support plate 21, with which the contact portions 221 and 251 are contacted. In contrast, the cleaning blade 22 illustrated in FIG. 12B is set on the opposite side of the support plate 21. It is preferable that the cleaning blade 22 has the configuration illustrated in FIG. 12A because even when the thickness of the support plate 21 changes, the conditions of contact of the cleaning blade 22 are hardly changed (i.e., the conditions of the cleaning blade 22 can be severely controlled).

In this embodiment, the cleaning member (cleaning blade) is fixed by contacting the both end portions of the support plate 21 with the contact portions 221 and 251. However, the method for fixing the cleaning member is not limited thereto, and any other methods can be used.

The cleaning blade 22 is typically made of an elastomer such as fluorine-containing rubbers, silicone rubbers, and urethane rubbers. Among these materials, urethane rubbers are preferably used because of having a good combination of abrasion resistance, resistance to ozone and contamination resistance.

The support plate 21 preferably has a L-shape so as not to be bent when the cleaning blade is contacted with the photoreceptor, i.e., such that the cleaning blade is precisely contacted with the photoreceptor. In addition, the support plate 21 is preferably a stainless steel plate having a thickness of 2.0 mm. In addition, iron plates, aluminum plates and copper plates (such as phosphor bronze) can also be used for the support plate 21.

In this embodiment, the cleaning blade 22 is adhered to the support plate 21 by a method in which an adhesive is coated on the support plate 21 and then the cleaning blade 22 is adhered thereto, followed by heating and/or pressing. However, the adhesion method is not limited thereto, and methods using a double-sided tape, etc., can also be used.

Figure 13:
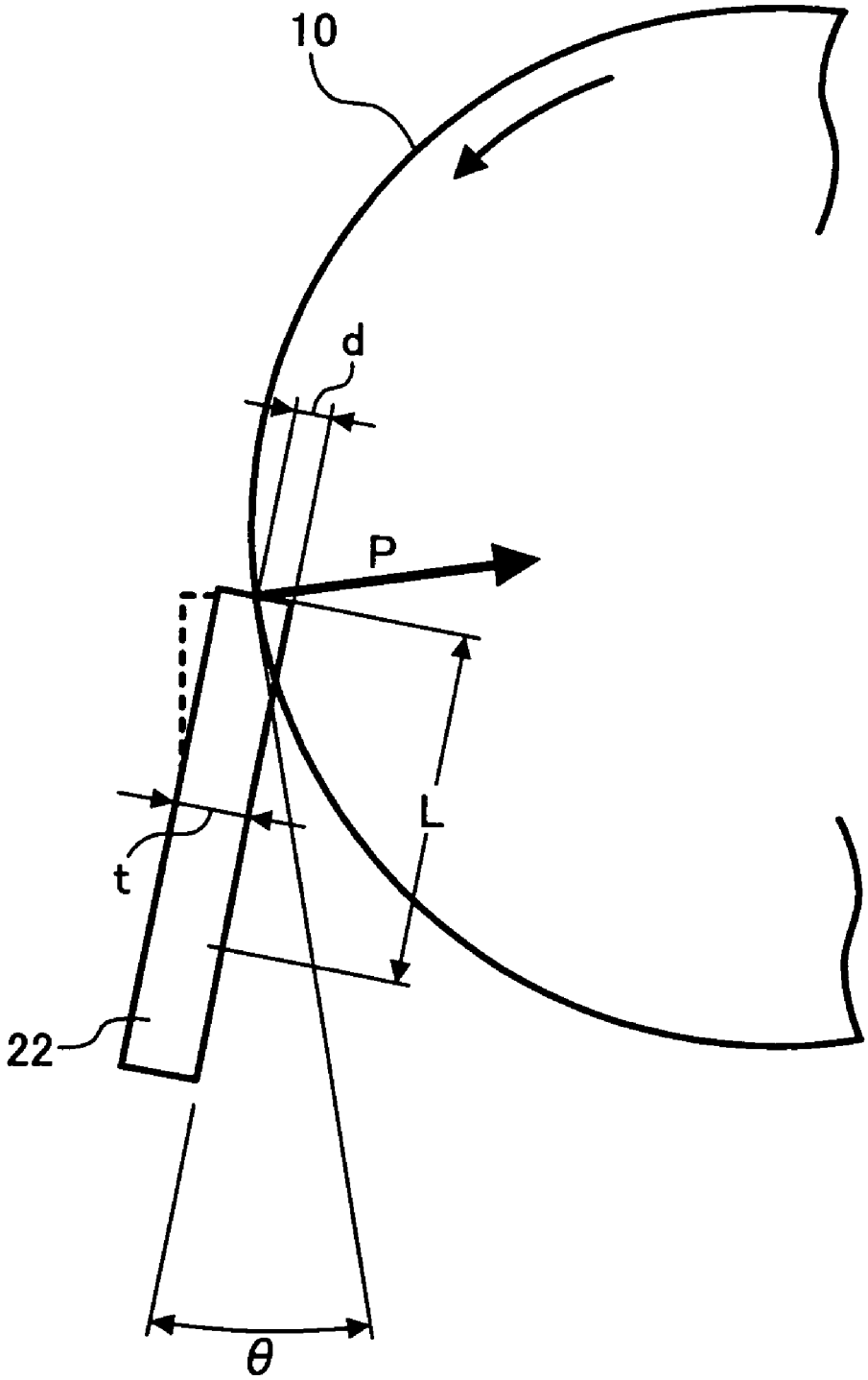
FIG. 13 is a schematic view for explaining the conditions of the cleaning blade pressure-contacted with a photoreceptor.

FIG. 13 is a schematic view for explaining the conditions of contact of the cleaning blade 22 with the surface of the photoreceptor 10. As illustrated in FIG. 13, the cleaning blade 22 is arranged so as to counter the rotated photoreceptor 10. The cleaning blade 22 can be contacted with the surface of the photoreceptor 10 while trailing along the surface of the photoreceptor 10. However, it is preferable to set the cleaning blade so as to counter the photoreceptor 10 because the surface of the photoreceptor can be well cleaned.

The cleaning blade 22 preferably has a hardness (JIS-A hardness) of from 60° to 85°. When the hardness is too low, the blade is largely deformed, and thereby toner particles on the surface of the photoreceptor cannot be well removed therefrom. In contrast, when the hardness is too high, the surface of the photoreceptor is seriously abraded, thereby shortening the life of the photoreceptor.

The contact pressure (P) at which the blade is contacted with the surface of the photoreceptor as illustrated in FIG. 13 is preferably from 10 to 60 gf/cm. When the contact pressure is too low, toner particles having a particle diameter less than 2 μm are hardly removed. In contrast, when the contact pressure is too high, a problem in that the tip of the blade is bent (i.e., rolled up) or bounded, resulting in occurrence of defective cleaning occurs.

In addition, the cleaning blade preferably has the following properties:

Elasticity: 4.5 to 10 MPa

Length (L) of unsupported portion: 5 to 12 mm

Thickness (t): 1 to 2 mm

Contact angle θ: 5° to 25°

Amount of deformation (d): 0.1 to 2.0 mm

When the contact angle θ, which is defined as an angle formed by the cleaning blade and a tangent line at a point of the surface of the photoreceptor in which the tip of the blade is contacted with the photoreceptor, is too low, toner particles remaining on the photoreceptor cannot be easily removed because the toner particles pass through the nip between the cleaning blade and the photoreceptor. In contrast, when the contact angle is too high, the blade bending/bounding problem mentioned above is caused.

When the deformation amount (d) is too small, toner particles remaining on the photoreceptor cannot be easily removed because the toner particles easily pass through the nip between the cleaning blade and the photoreceptor. In contrast, when the deformation amount (d) is too large, the blade bending/bounding problem mentioned above is caused because the friction between the cleaning blade and the photoreceptor increases.

Figure 14:
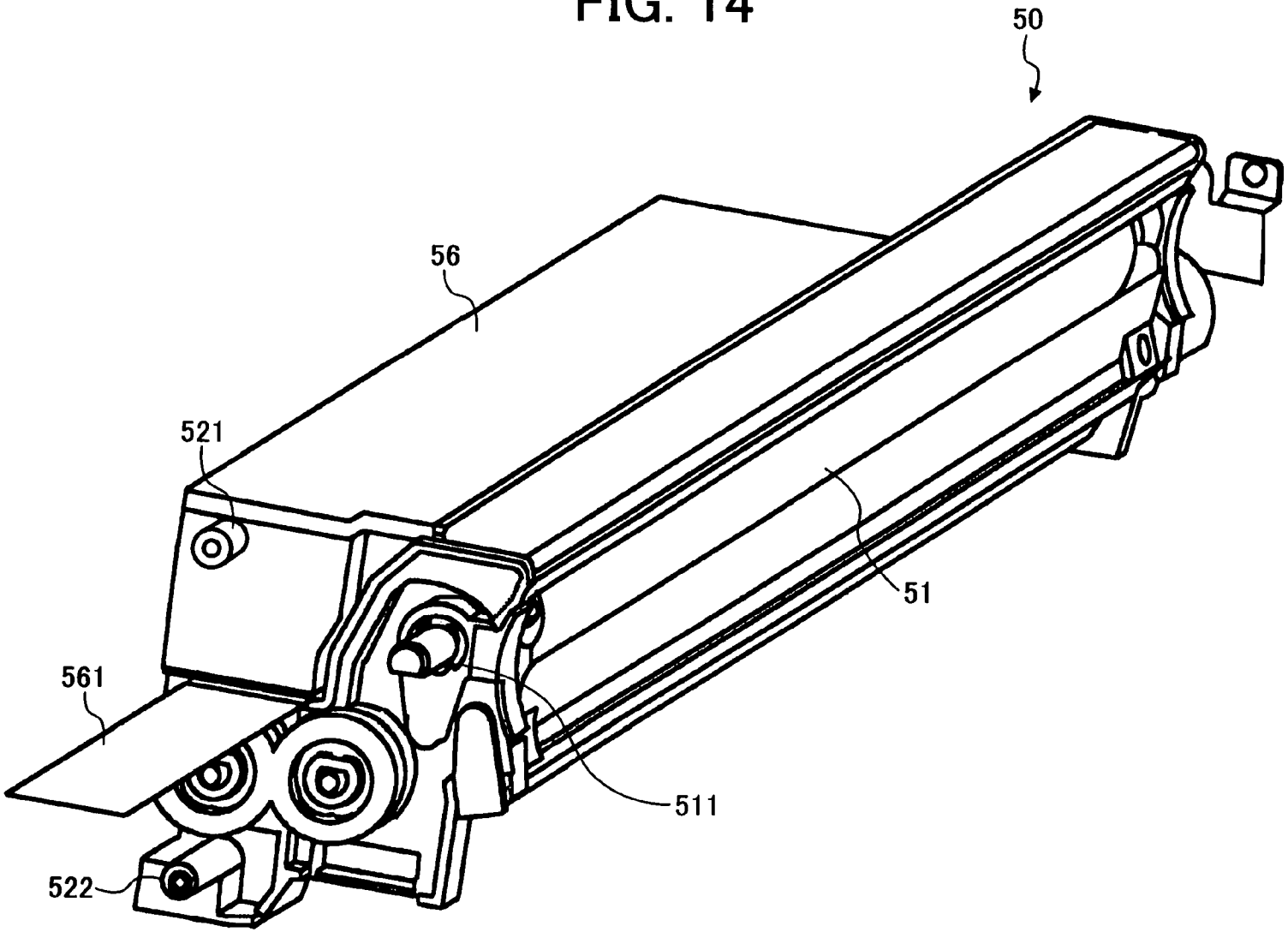
FIG. 14 is a schematic view illustrating a developing module for use in the process cartridge of the present invention.

FIG. 14 illustrates the developing module 50 for use in the process cartridge of the present invention. The cross section of the developing module 50 is illustrated in FIG. 2. As illustrated in FIG. 2, the developing module 50 includes a developing sleeve 51 which serves as a developer bearing member and which is arranged so as to be close to the photoreceptor 10, an opening (not shown) from which a toner is supplied from a toner bottle containing the toner by a toner supplying device, mixing screws which mix the supplied toner with a magnetic carrier, and a developer controlling member 55 which controls the thickness of the developer on the surface of the developing sleeve 51.

In addition, as illustrated in FIG. 14, The developing module 50 includes a rotation shaft which rotates the developing sleeve 51, guides 521 and 522 which are projections provided at upper and lower positions of the main body of the developing module 50 and which are used for positioning the developing module when the developing module is set to the process cartridge, a partition plate 561 which is provided for preventing the developer therein from leaking from the developing module 50 when the developing module is transported, and a developer containing portion 56 which contains the developer while separated therefrom by the partition plate 561. The toner contained in the developer containing portion 56 by the partition plate 561 is fed to the mixing screw 53 by removing the partition plate 561 from the developing module 30 when the developing module is used for the first time.

The developing sleeve 51 is typically a cylinder made of anon-magnetic material such as aluminum, brass, stainless steel, and electroconductive resins. By rotating the developing sleeve using a rotation driving mechanism, the developer on the surface of the developing sleeve is fed due to magnet poles of magnets provided in the developing sleeve. The height of the developer brush (i.e., the weight of the developer layer on the developing sleeve) is controlled by the controlling member provided on an upstream side from the developing region relative to the rotation direction of the developing sleeve 51.

In the image forming apparatus, not only two component developers including a toner and a magnetic carrier, but also magnetic one component developers and non-magnetic one component developers can be used as the developer. In these cases, the configuration of the developing sleeve is preferably changed depending on the developers used.

Figure 15:
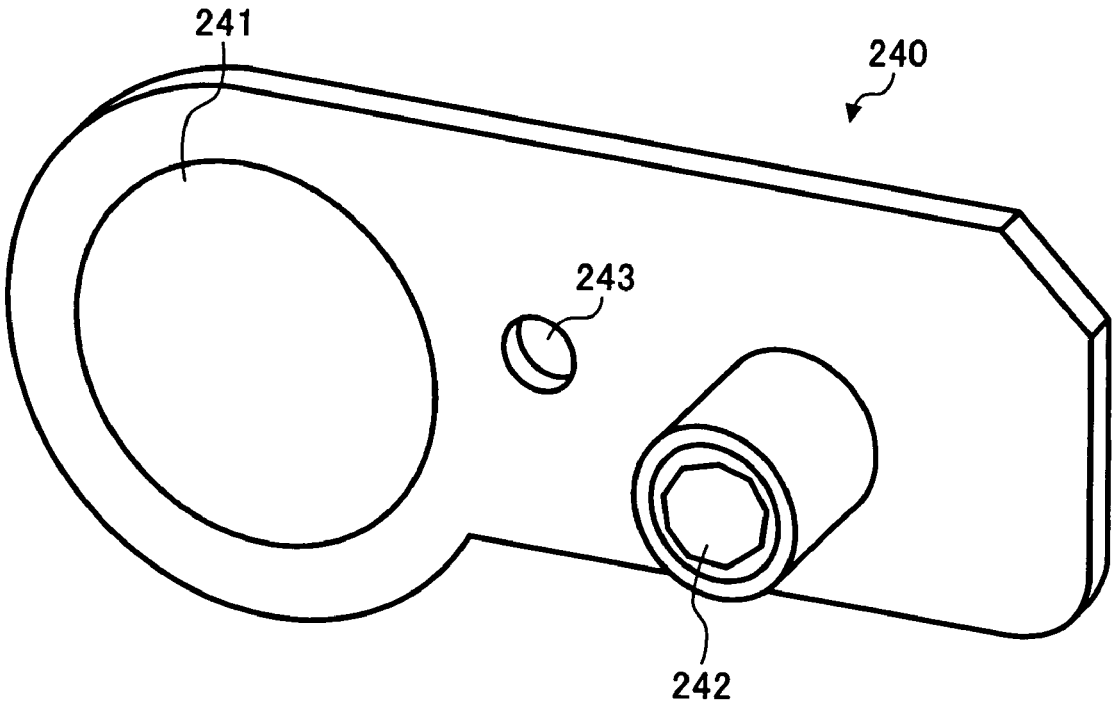
FIG. 15 is a schematic view illustrating a face plate for use in positioning the developing module in the process cartridge.

FIG. 15 illustrates a faceplate 240 for use in positioning the developing module in the process cartridge.

The face plate 240 has an opening 241 through which a bearing 244 supporting the rotation shaft 14 of the photoreceptor 10 is introduced to position the developing module relative to the photoreceptor, an opening 242 through which a shaft 511 of the developing sleeve 51 is introduced, and an opening 243 into which a screw is inserted to fix the face plate 240 to the side plate 220 of the frame 210 of the process cartridge.

Figure 16:
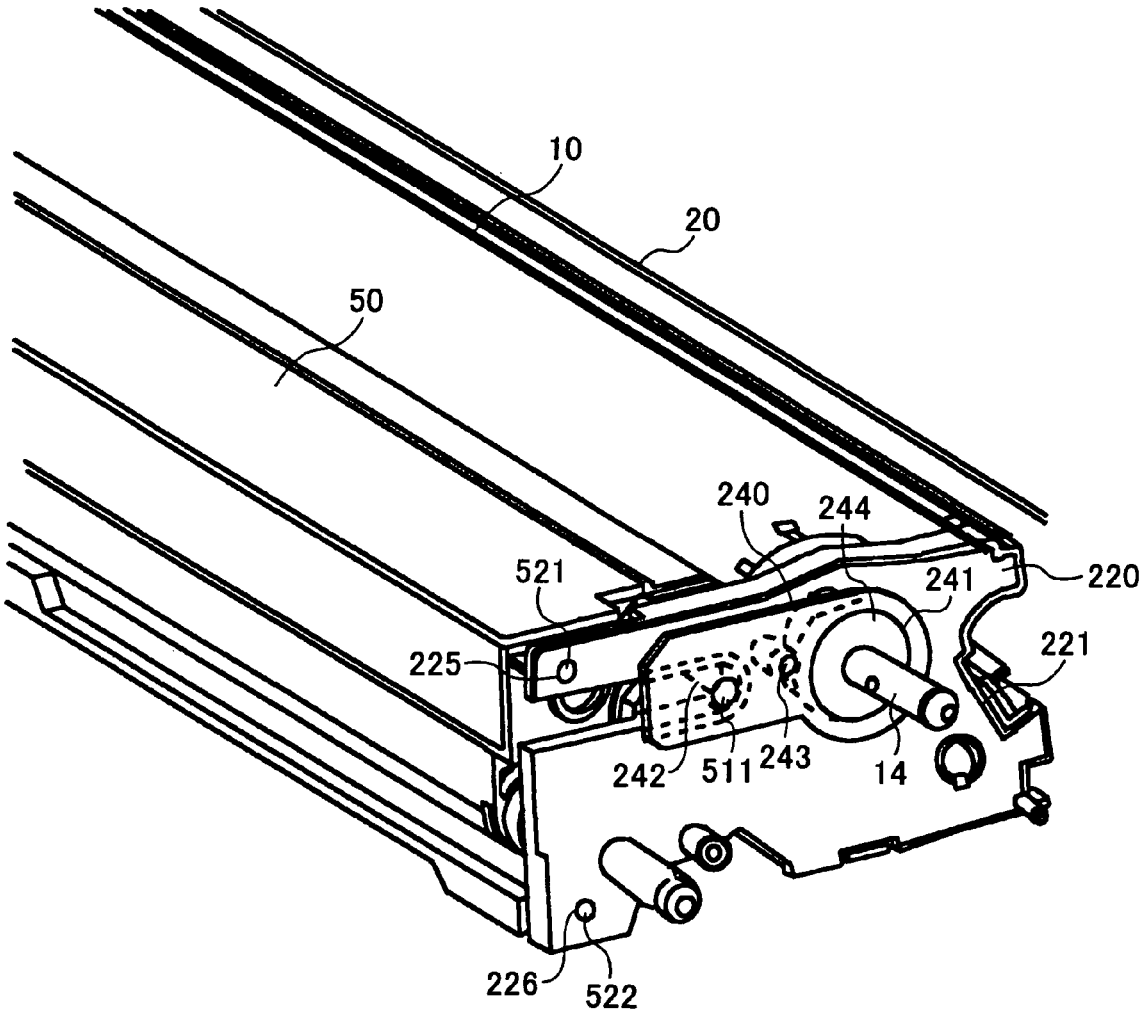
FIG. 16 is a schematic view illustrating the developing module positioned in the process cartridge using the face plate.

FIG. 16 illustrates the developing module which is set to the process cartridge while positioned relative to the process cartridge using the face plate 240. As illustrated in FIG. 16, the bearing 244 provided on the side plate 220 of the frame 210 is engaged with the opening 241, and thereby the rotation shaft 14 of the photoreceptor 10 is positioned. In addition, since the bearing 244 provided on the side plate 220 of the frame 210 is engaged with the opening 241 and the shaft 511 of the developing sleeve 51 is engaged with the opening 242, the developing sleeve 51 is positioned relative to the rotation shaft 14 of the photoreceptor 10. After completing the positioning operations, the guides (i.e., projections) 521 and 522 of the developing module are inserted into the holes 225 and 226, respectively. Thus, the developing module 50 is fixed to the frame 210.

Figure 17:
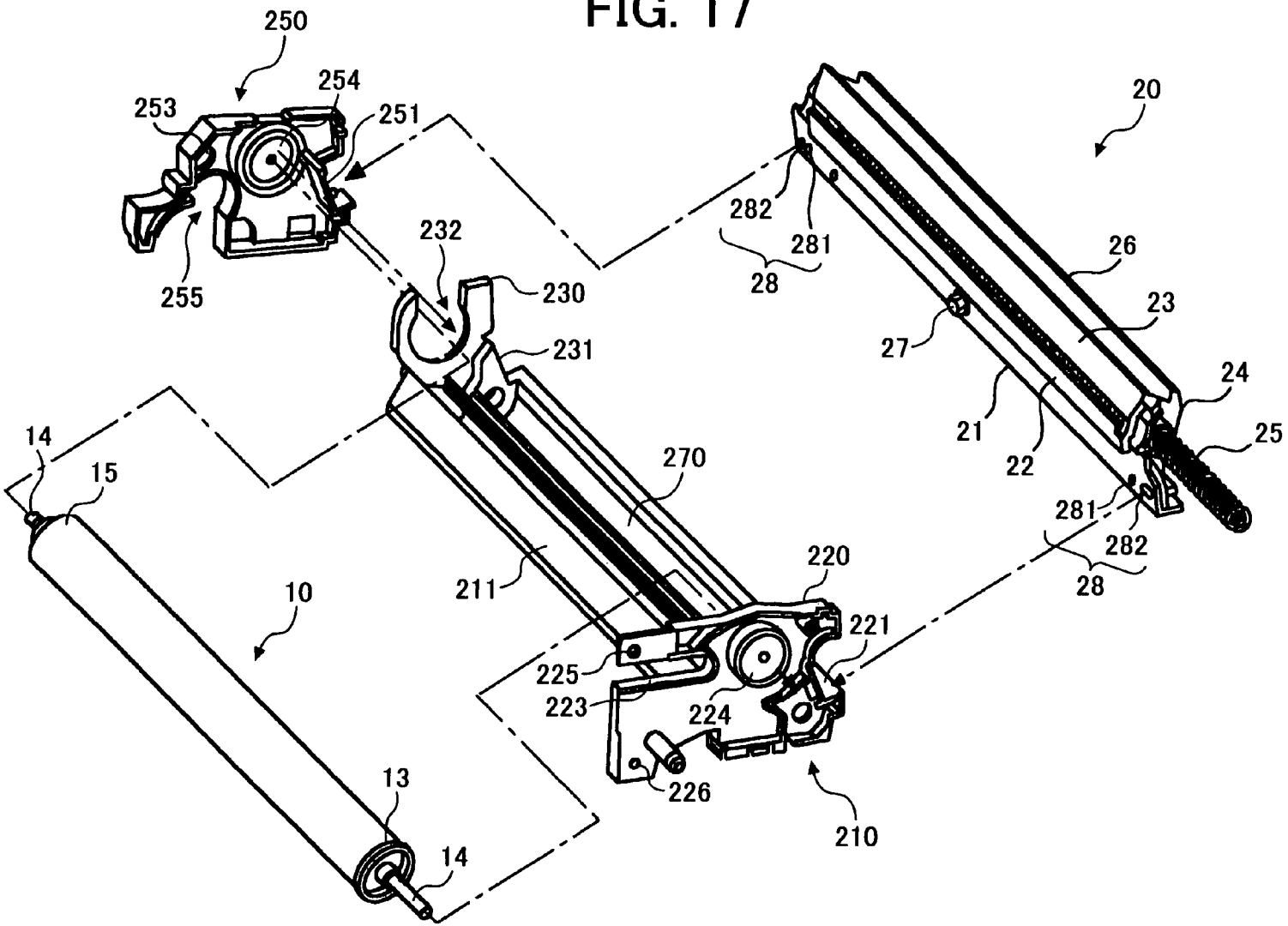
FIG. 17 is a schematic view for explaining the way to assemble the process cartridge.

FIG. 17 is a schematic view for explaining the way to assemble the process cartridge. As illustrated in FIG. 17, the process cartridge 200 is assembled by setting the photoreceptor 10 and the charging module 30 to the positioning plate 211 provided on the side plate 220 of the frame 210 while the cleaning module 20 is set to the contact portions 221 and 251.

Specifically, at first, the shaft 14 of the photoreceptor 10 is inserted into the bearing 244 set on the side plate 220 of the frame 210. In addition, the shaft 14 is also inserted into the bearing 254 set on the side plate 250. Then the photoreceptor 10 is fixed to the side plate 230 of the frame 210. The charging module (which is not illustrated in FIG. 17) is then set to the process cartridge as mentioned above.

Further, the guides 28 (i.e., 281 and 282) of the support plate 21 supporting the cleaning blade 22 are fixed to the contact portions 221 and 251, respectively, while positioned. Thus, the cleaning module 20 is set to the process cartridge. Thus, it is possible to easily assemble the process cartridge using only a small number of parts while the modules constituting the process cartridge are precisely positioned without causing a bending problem in that the modules are arranged while bent.

Then the methods for assembling the modules and parts will be explained in detail.

Figure 18:
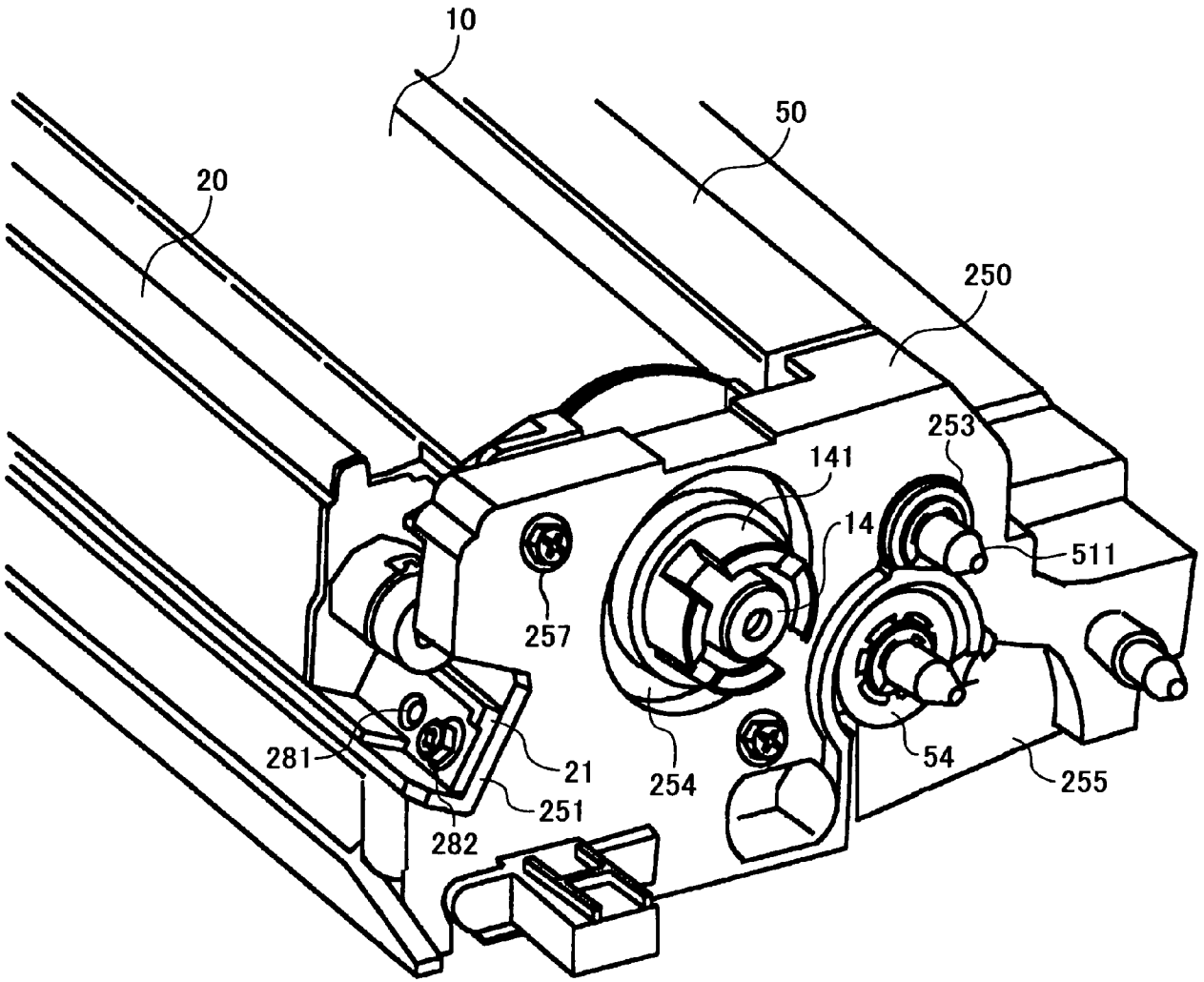
FIG. 18 is a schematic view illustrating the photoreceptor set in the process cartridge.

FIG. 18 illustrates the photoreceptor 10 which is set to the side plate 250. After the shaft 14 of the photoreceptor 10 is inserted into the bearing 254 of the side plate 250 to position the photoreceptor 10, a coupling 141 is set on the end portion of the shaft 14. When the process cartridge is set in the image forming apparatus 100, the coupling 141 is engaged with a driving device (not shown) provided on the main body of the image forming apparatus 100, and thereby the photoreceptor 10 is rotated. In addition, the cleaning module 20 is set to the process cartridge by contacting the support plate 21 with the contact portion 251 of the side plate 250, engaging the guide 281 with the projection provided on the contact portion 251, and fixing the support plate 21 with the contact portion 251 by screw cramp through the hole 282.

In addition, the developing module 50 is set to the process cartridge by inserting the shaft 511 of the developing sleeve 51 into a shaft supporting portion 253. Thus, the developing module 50 is fixed to the side plate 250.

As mentioned above, each of the contact portions 221 and 251, which are provided on the side plates 220 and 250, respectively, has the projection and hole for fixing the support plate 21, i.e., for positioning the cleaning module 20. Since the support plate 21 is supported by both the end portions of the process cartridge, the cleaning blade 22, which is provided on the support plate 21, can be precisely positioned relative to the photoreceptor 10. In addition, since the widths of the bearings 244 and 254 are not greater than the widths of the contact portions 221 and 251, respectively, and the bearings are located near the contact portions, the support plate 21 can be fixed so as to face the bearings 244 and 254. Therefore, the distance and angle between the support plate 21 and the rotation shaft 14 of the photoreceptor 10 supported by the bearings can be precisely controlled, and thereby the cleaning blade 22 can be precisely positioned relative to the photoreceptor 10. Further, since the support plate is made of a material having a high strength (in this embodiment, a steel plate having a thickness of 2.0 mm is used), the cleaning blade 22 can be positioned more precisely relative to the photoreceptor 10.

It is preferable that a metal is used for the support plate 21 to impart high rigidity thereto. By using such a material for the support plate 21, occurrence of a problem in that the support plate is bent and twisted when the support plate is fixed to the side plates 220 and 250, which is caused by variation in dimension of the side plates 220 and 250, the frame 210, etc., can be prevented. In addition, it is preferable that the side plates 220 and 250 are separate parts. This is because when the side plates are prepared as one part, the bending problem often occurs. In addition, since the side plates 220 and 250 can be positioned relative to the support plate 21 having a rigidity greater than that of the frame 210, the process cartridge itself can be precisely assembled.

In addition, by setting the developing module 50 and the charging module 30 to the process cartridge 200 after setting the cleaning module 20 to the process cartridge, the developing module 50 and the charging module 30 can be incorporated with high precision in the process cartridge because the cleaning module 20 is incorporated in the process cartridge without bending and twisting.

When the cleaning module 20 is set to the frame 210 of the process cartridge, a rotation force is generated while the support plate 21 serves as a center of the rotation even though the cleaning blade 22 is contacted with the photoreceptor 10 with high precision. Therefore, in order to prevent the rotation of the cleaning module 20, a fixing member 257 is provided to fix the cleaning module to the process cartridge 200, i.e., the face plates 240 and 250. Suitable devices for use as the fixing member 257 include screws and pins.

Figure 19:
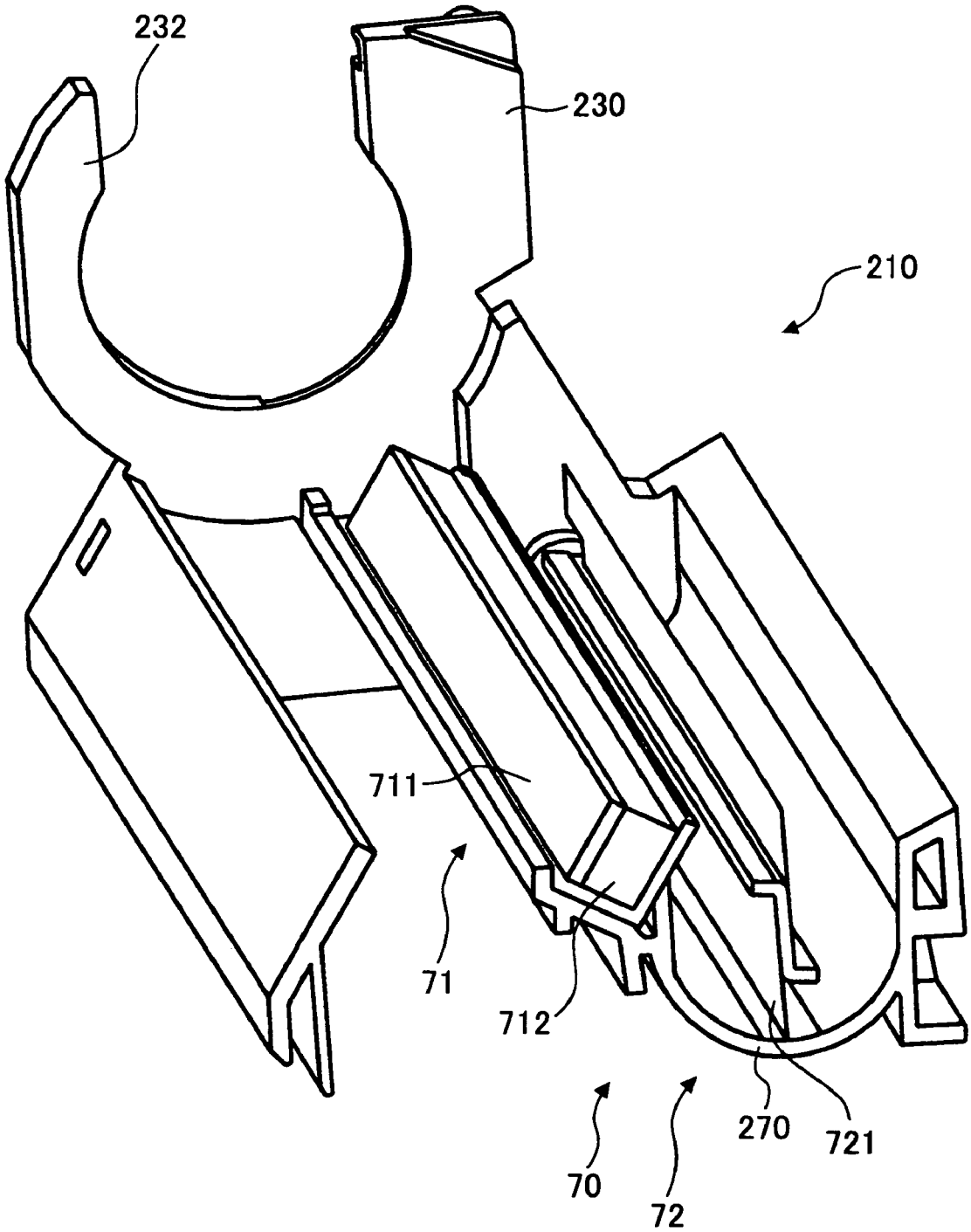
FIG. 19 is a schematic view illustrating a lubricant applicator for applying a lubricant to the surface of the photoreceptor in the process cartridge.

FIG. 19 is a cross section illustrating the lubricant applicator 70. As illustrated in FIGS. 2 and 19, the lubricant applicator 70 is arranged separately from the cleaning module 20, and includes a film forming member 71 which forms a thin film of a lubricant, a supplying member 72 which is rotated in the same direction as that of the photoreceptor 10, and a lubricant container 270 which is provided on the frame 210 and contains the lubricant. The supplying member 72 includes a film 721 which supplies the lubricant to the photoreceptor 10.

The supplying member 72 is not limited to the structure illustrated in FIG. 19, and, for example, a member including a metal roller on which a brush is formed can also be used.

Suitable materials for use as the film 721 include polyester resins, fluorine-containing resins, styrene resins, and acrylic resins. Suitable materials for use as the brush include polyamide resins (such as nylons) as well as the resins mentioned above for use as the film 721. In this regard, electroconductive powders such as carbon blacks (e.g., acetylene black and furnace black), graphite, and powders of metals (e.g., copper and silver) can be included in the film or the brush. The film or the brush preferably has a resistivity of from $10^2$ to $10^8$ Ω·cm.

The film forming member 71 includes a coating blade 711 and a blade supporting member 712 configured to support the coating blade 711. The coating blade 711 is typically made of an elastomer such as fluorine-containing resins, urethane resins, and silicone resins. Among these materials, urethane resins are preferably used because of having high elasticity and good abrasion resistance. The blade supporting member 712 is typically made of a foamed material such as foamed resins (e.g., silicone resins, fluorine-containing resins and urethane resins). Among these resins, foamed urethane resins are preferably used. By using such a foamed material, the coating blade is prevented from being contacted with the photoreceptor 10 at an excessively high pressure, resulting in formation of a uniform lubricant layer while preventing excessive abrasion loss of the surface of the photoreceptor 10.

The coating blade 711 is contacted with the photoreceptor 10 in a countering manner such that the blade is set so as to counter the rotated photoreceptor or a trailing manner such that the blade is set so as to trail along the surface of the photoreceptor. In order to uniformly coat a lubricant on the surface of the photoreceptor and to prevent the blade from being rolled up, the contact pressure of the blade 711 is preferably from 5 to 30 N/m and the contact angle of the blade is preferably from 10° to 30°. Other conditions of the blade 711 (such as deformation amount) are determined depending on the elasticity of the blade used. In this case, a lubricant having a low hardness is applied to form a thin layer of the lubricant on the surface of the photoreceptor 10. Therefore, the contact pressure of the coating blade 711 is set so as to be lower than that of the cleaning blade 22 for use in cleaning the surface of the photoreceptor 10.

In the lubricant applicator 70, the lubricant contained in the supplying member 72 is applied to the surface of the photoreceptor 10 with the film 721. The applied lubricant is rubbed with the coating blade 711 to form a thin layer of the lubricant on the surface of the photoreceptor 10. Thus, the friction coefficient of the surface of the photoreceptor can be decreased, thereby enhancing the transfer rate of toner images. Therefore, the amount of waste toner particles can be reduced.

In addition, by decreasing the friction coefficient of the surface of the photoreceptor 10, toner particles remaining on the surface of the photoreceptor can be easily removed therefrom even when the toner is a spherical toner, which is hard to clean because of having a rolling property. Further, by forming a thin layer of the lubricant using the blade 711, the extra amount of lubricant is scraped off by the blade 711. Therefore, the minimal amount of lubricant is coated on the surface of the photoreceptor. Furthermore, the extra amount of lubricant scraped off by the blade 711 is returned to the lubricant container 270. Therefore, the lubricant can be used without loss.

Suitable materials for use as the lubricant include fatty acid metal salts such as lead oleate, zinc oleate, copper oleate, zinc stearate, calcium stearate, cobalt stearate, iron stearate, copper stearate, zinc palmitate, copper palmitate, and zinc linolate; and fluorine-containing resins such as polytetrafluoroethylene, polychlorotrifluoroethylene, polyvinylidene fluoride, polydichlorodifluoroethylene, tetrafluoroethylene-ethylene copolymers, tetrafluoroethylene-oxafluoropropylene copolymers, etc. Among these materials, fatty acid metal salts are preferably used, and more preferably zinc or calcium salts of fatty acids (preferably, stearic acid) are preferable. Even more preferably, zinc stearate and calcium stearate are used.

It is preferable that the lubricant has a powder form, and has a volume average particle diameter of from 0.1 to 3.0 mm. By using such a lubricant powder, a thin layer of the lubricant can be easily formed. When the volume average particle diameter of the lubricant powder is too small, a problem in that the applied lubricant particles pass through the nip between the surface of the photoreceptor occurs. In contrast, when the volume average particle diameter is too large, a problem in that the lubricant powder is removed by the coating blade 711 from the surface of the photoreceptor 10, and therefore a thin layer of the lubricant cannot be formed. When a molded lubricant is used, the lubricant has to be strongly rubbed with a brush to form a powder of the lubricant. Therefore, the brush has a short life. In addition, the strength of the shaft of the brush and the gear used for rotating the brush has to be increased, resulting in increase of manufacturing costs of the lubricant applicator 70.

Figure 20:
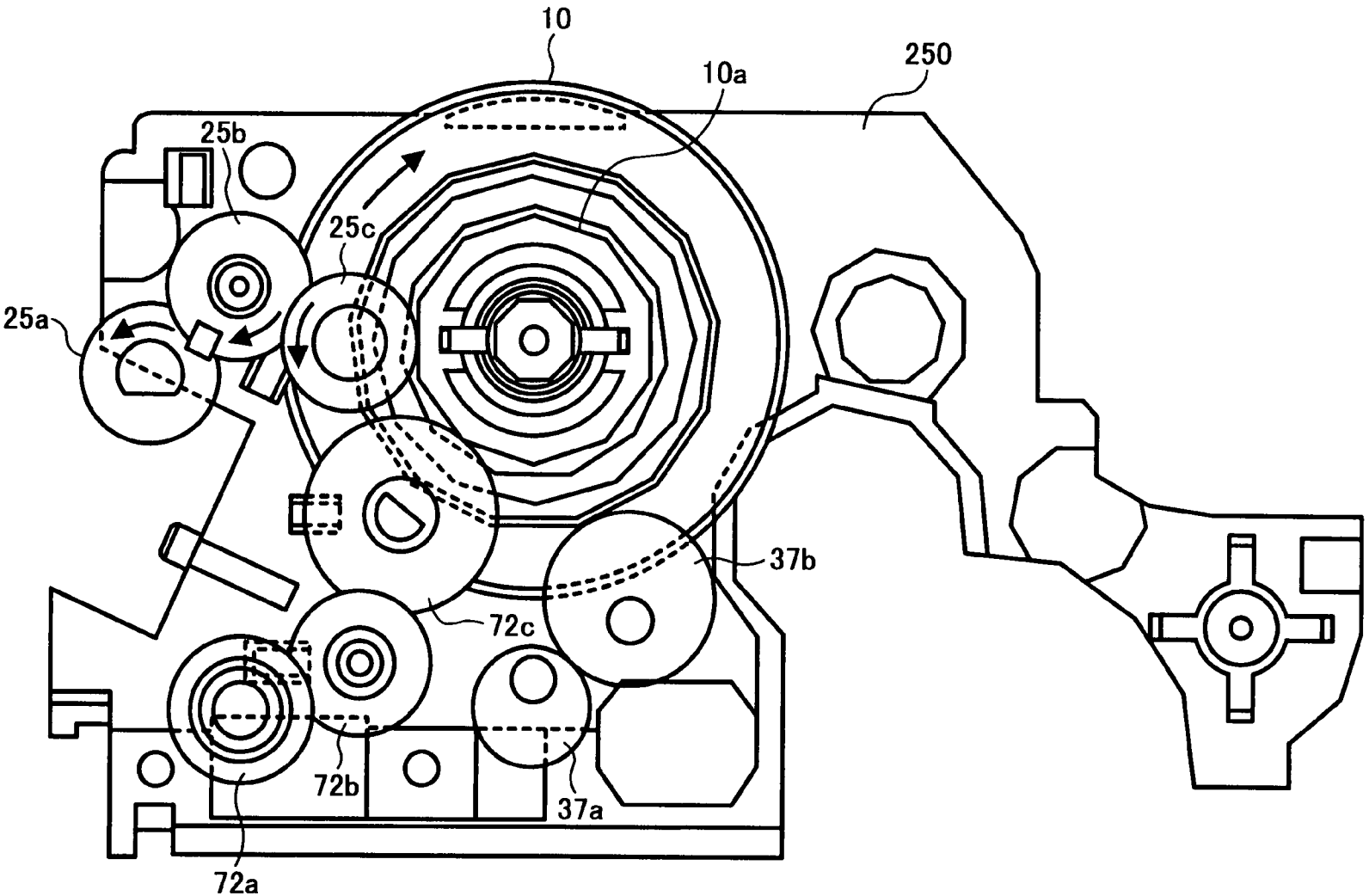
FIG. 20 is a schematic view illustrating a gear train provided on one side of the process cartridge.

FIG. 20 is a schematic view illustrating a gear train provided on one side of the process cartridge. The photoreceptor 10 is rotated by a driving device provided in the main body of the image forming apparatus. The torque of a photoreceptor gear 10*a* provided on the rotation shaft 14 of the photoreceptor 10 is transmitted to the feeding auger 25 (illustrated in FIG. 11A) via auger gears 25*a*, 25*b* and 25*c*. When the feeding auger 25 is rotated, collected toner particles contained in the housing 26 (illustrated in FIG. 11A) of the cleaning module 20 are fed to the outside of the process cartridge. In addition, the torque of the photoreceptor gear 10*a* is transmitted to the feeding member 72 via gears 72*a*, 72*b* and 72*c*. When the feeding member 72 is rotated, the lubricant is supplied to the surface of the photoreceptor 10. Further, the torque of the photoreceptor gear 10*a* is transmitted to the charging member 31 via gears 37*a* and 37*b*, and thereby the surface of the photoreceptor 10 is uniformly charged.

In this embodiment, the rotation speed of the lubricant feeding member 72 is greater than that of the photoreceptor 10. Therefore, occurrence of a problem in that the amount of the lubricant fed to the photoreceptor 10 becomes smaller than the required amount can be prevented. However, it is preferable that the rotation speeds of the feeding member 72 and the photoreceptor 10 are properly controlled such that a proper amount of lubricant is applied to the surface of the photoreceptor.

The process cartridge 200 can include detectors such as a temperature/humidity sensor for measuring the temperature/humidity in the process cartridge; a potential sensor configured to measure the potential of the photoreceptor; and a toner density sensor configured to measure the amount of the toner in a toner image formed on the photoreceptor. Further, the process cartridge can include a pre-transfer discharging device configured to discharge the photoreceptor before the transfer process and a pre-cleaning discharging device configured to discharge the photoreceptor before the cleaning process.

The charging module 30 is integrated with the frame of the process cartridge 200 including the photoreceptor 10 while detachably attached thereto. In addition, the process cartridge 200 is detachably attached to the image forming apparatus 100.

In order to easily assemble the process cartridge 200, the image forming devices such as charging device and cleaning device are previously unitized. Therefore, the image forming devices can be easily attached to or detached from the process cartridge. The charging module 30 has a constitution such that the pressure applied to the cleaning roller 33 by the charging roller 31 is weakened, and therefore occurrence of the compression strain can be prevented. Therefore, the charging module 30 can be preserved for a long period of time without causing the deformation problem.

Since the charging module 30 has such a configuration, the surface of the charging roller 31 can be securely cleaned for a long period of time. Therefore, even when a toner having a small average particle diameter or a polymerized toner is used, particles of the toner remaining on the charging roller 31 can be securely removed therefrom. Namely, occurrence of defective charging due to deterioration of the charging member can be prevented. In other words, the performance of the charging member 31 can be maintained for a long period of time.

Then the toner for use in the image forming apparatus 100 of the present invention will be explained.

In order to reproduce images with a resolution not less than 600 dpi (dots per inch), the toner preferably has a volume average particle diameter (Dv) not greater than 10 μm, and more preferably from 3 to 8 μm. In addition, the ratio (Dv/Dn) of the volume average particle diameter (Dv) to the number average particle diameter (Dn) of the toner is preferably from 1.00 to 1.40. As the ratio (Dv/Dn) approaches 1.00, the particle diameter distribution of the toner becomes sharp. Such a toner as having a relatively small particle diameter and a sharp particle diameter distribution has a uniform charge quantity. Therefore, by using such a toner, high quality images can be produced without causing a background development problem in that the background areas of images are soiled with toner particles. In addition, by using such a toner, the toner image transfer efficiency can be enhanced when a toner image is transferred from an image bearing member to a receiving material using an electrostatic transfer method.

The toner for use in the image forming apparatus of the present invention is preferably a polymerization toner which is prepared by subjecting a toner composition liquid, which includes at least a polyester prepolymer having a nitrogen-containing group, a polyester resin, a colorant and a release agent, to a crosslinking reaction and/or a molecular chain extension reaction in an aqueous medium.

Hereinafter the method for preparing such a polymerization toner will be explained in detail.

(Modified Polyester)

The toner for use in the image forming apparatus and process cartridge of the present invention preferably includes a modified polyester resin (i). In this application, the modified polyester resin is defined as a polyester resin which has a bond other than the ester bond or which includes therein another resin component which is bonded with the polyester resin component by a covalent bond, ionic bond or other bond. Specifically, the modified polyester resin is defined as a modified polyester resin prepared by incorporating a group such as an isocyanate group, which is reactive with a carboxyl group, and a hydroxyl group, at an end portion thereof, and then reacting the group with a compound having an active hydrogen atom.

Suitable modified polyester resins for use in the toner in the present invention include urea-modified polyester resins which are prepared by reacting a polyester prepolymer (A) having an isocyanate group with an amine (B). Polyester prepolymers (A) can be prepared by a polycondensation product of a polyol (PO) and a polycarboxylic acid (PC) (i.e., a polyester resin having a group including an active hydrogen atom) with a polyisocyanate (PIC). Specific examples of the group including an active hydrogen atom include hydroxyl groups (alcoholic hydroxyl group and phenolic hydroxyl group), amino groups, carboxyl groups, mercapto groups, etc. Among these groups, the alcoholic hydroxyl group is preferable.

Suitable polyols (PO) for use in preparing the modified polyester resin include diols (DIO), polyols (TO) having three or more hydroxyl groups, and mixtures of DIO and TO. Preferably, diols (DIO) alone or mixtures of a diol (DIO) and a small amount of polyol (TO) are used.

Specific examples of the diols (DIO) include alkylene glycols, alkylene ether glycols, alicyclic diols, bisphenols, alkylene oxide adducts of alicyclic diols, alkylene oxide adducts of bisphenols, etc.

Specific examples of the alkylene glycols include ethylene glycol, 1,2-propylene glycol, 1,3-propylene glycol, 1,4-butanediol and 1,6-hexanediol. Specific examples of the alkylene ether glycols include diethylene glycol, triethylene glycol, dipropylene glycol, polyethylene glycol, polypropylene glycol and polytetramethylene ether glycol. Specific examples of the alicyclic diols include 1,4-cyclohexane dimethanol and hydrogenated bisphenol A. Specific examples of the bisphenols include bisphenol A, bisphenol F and bisphenol S. Specific examples of the alkylene oxide adducts of alicyclic diols include adducts of the alicyclic diols mentioned above with an alkylene oxide (e.g., ethylene oxide, propylene oxide and butylene oxide) Specific examples of the alkylene oxide adducts of bisphenols include adducts of the bisphenols mentioned above with an alkylene oxide (e.g., ethylene oxide, propylene oxide and butylene oxide).

Among these compounds, alkylene glycols having from 2 to 12 carbon atoms and alkylene oxide adducts of bisphenols are preferable. More preferably, alkylene oxide adducts of bisphenols, and mixtures of an alkylene oxide adduct of a bisphenol and an alkylene glycol having from 2 to 12 carbon atoms are used.

Specific examples of the polyols (TO) include aliphatic alcohols having three or more hydroxyl groups (e.g., glycerin, trimethylol ethane, trimethylol propane, pentaerythritol and sorbitol); polyphenols having three or more hydroxyl groups (trisphenol PA, phenol novolak and cresol novolak); adducts of the polyphenols mentioned above with an alkylene oxide such as ethylene oxide, propylene oxide and butylene oxide; etc.

Suitable polycarboxylic acids (PC) for use in preparing the modified polyester resin include dicarboxylic acids (DIC) and polycarboxylic acids (TC) having three or more carboxyl groups. Preferably, dicarboxylic acids (DIC) alone and mixtures of a dicarboxylic acid (DIC) with a small amount of polycarboxylic acid (TC) are used.

Specific examples of the dicarboxylic acids (DIC) include alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acids; etc. Among these compounds, alkenylene dicarboxylic acids having from 4 to 20 carbon atoms and aromatic dicarboxylic acids having from 8 to 20 carbon atoms are preferably used.

Specific examples of the polycarboxylic acids (TC) having three or more hydroxyl groups include aromatic polycarboxylic acids having from 9 to 20 carbon atoms (e.g., trimellitic acid and pyromellitic acid).

When a polycarboxylic acid (PC) is reacted with a polyol (1), anhydrides or lower alkyl esters (e.g., methyl esters, ethyl esters or isopropyl esters) of the polycarboxylic acids mentioned above can also be used as the polycarboxylic acid (PC).

Suitable mixing ratio (i.e., the equivalence ratio [OH]/[COOH]) of the [OH] group of a polyol (PO) to the [COOH] group of a polycarboxylic acid (PC) is from 2/1 to 1/1, preferably from 1.5/1 to 1/1 and more preferably from 1.3/1 to 1.02/1.

Specific examples of the polyisocyanates (PIC) for use in preparing the modified polyester resin include aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic diisocianates (e.g., tolylene diisocyanate and diphenylmethane diisocyanate); aromatic aliphatic diisocyanates (e.g., $\alpha$, $\alpha$, $\alpha'$, $\alpha'$-tetramethyl xylylene diisocyanate); isocyanurates; blocked polyisocyanates in which the polyisocyanates mentioned above are blocked with phenol derivatives, oximes or caprolactams; etc. These compounds can be used alone or in combination.

Suitable mixing ratio (i.e., the equivalence ratio [NCO]/[OH]) of the [NCO] group of a polyisocyanate (PIC) to the [OH] group of a polyester is from 5/1 to 1/1, preferably from 4/1 to 1.2/1 and more preferably from 2.5/1 to 1.5/1. When the [NCO]/[OH] ratio is too large, the low temperature fixability of the toner deteriorates. In contrast, when the ratio is too small, the content of the urea group in the modified polyesters decreases, thereby deteriorating the hot-offset resistance of the toner.

The content of the polyisocyanate unit in the polyester prepolymer (A) having an isocyanate group is from 0.5 to 40% by weight, preferably from 1 to 30% by weight and more preferably from 2 to 20% by weight. When the content is too low, the hot offset resistance of the toner deteriorates and in addition a good combination of preservability and low temperature fixability cannot be imparted to the resultant toner. In contrast, when the content is too high, the low temperature fixability of the toner deteriorates.

The average number of the isocyanate group included in a molecule of the polyester prepolymer (A) is generally not less than 1, preferably from 1.5 to 3, and more preferably from 1.8 to 2.5. When the average number of the isocyanate group is too small, the molecular weight of the resultant urea-modified polyester (which is crosslinked and/or extended) decreases, thereby deteriorating the hot offset resistance of the resultant toner.

The urea-modified polyester resin for use as a binder resin of the toner of the present invention can be prepared by reacting a polyester prepolymer (A) having an isocyanate group with an amine (B).

Specific examples of the amines (B) include diamines (B1), polyamines (B2) having three or more amino groups, amino alcohols (B3), aminomercaptans (B4), amino acids (B5) and blocked amines (B6) in which the amines (B1-B5) mentioned above are blocked. These amines can be used alone or in combination.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophoron diamine); aliphatic diamines (e.g., ethylene diamine, tetramethylene diamine and hexamethylene diamine); etc.

Specific examples of the polyamines (B2) having three or more amino groups include diethylene triamine, triethylene tetramine, etc. Specific examples of the amino alcohols (B3) include ethanol amine, hydroxyethyl aniline, etc. Specific examples of the amino mercaptan (B4) include aminoethyl mercaptan, aminopropyl mercaptan, etc. Specific examples of the amino acids (B5) include aminopropionic acid, amino caproic acid, etc. Specific examples of the blocked amines (B6) include ketimine compounds which are prepared by reacting one of the amines (B1-B5) mentioned above with a ketone such as acetone, methyl ethyl ketone and methyl isobutyl ketone; oxazoline compounds, etc. Among these amines, diamines (B1) and mixtures of a diamine (B1) with a small amount of a polyamine (B2) are preferably used.

The molecular weight of the urea-modified polyesters can be controlled using a molecular chain extension inhibitor, if desired. Specific examples of the molecular chain extension inhibitor include monoamines (e.g., diethyl amine, dibutyl amine, butyl amine and lauryl amine), and blocked amines (i.e., ketimine compounds) prepared by blocking the monoamines mentioned above.

The mixing ratio (i.e., the equivalence ratio [NCO]/[NHx]) of the [NCO] group of the prepolymer (A) having an isocyanate group to the [NHx] group of the amine (B) is from 1/2 to 2/1, preferably from 1/1.5 to 1.5/1 and more preferably from 1/1.2 to 1.2/1. When the mixing ratio is too low or too high, the molecular weight of the resultant urea-modified polyester decreases, resulting in deterioration of the hot offset resistance of the resultant toner.

The urea-modified polyester resins for use in the toner can include a urethane bonding as well as a urea bonding. The molar ratio of the urea bonding to the urethane bonding is from 100/0 to 10/90, preferably from 80/20 to 20/80, and more preferably from 60/40 to 30/70. When the molar ratio of the urea bonding is too low, the hot offset resistance of the resultant toner deteriorates.

The modified polyesters (i) can be prepared, for example, by a method such as one-shot methods or prepolymer methods. The weight average molecular weight of the modified polyesters (i) is generally not less than 10,000, preferably from 20,000 to 1,000,000 and more preferably from 30,000 to 1,000,000. When the weight average molecular weight is too low, the polyester resins are hardly subjected to a molecular chain extension reaction, and thereby the resultant toner has poor elasticity. As a result, the hot offset resistance of the resultant toner deteriorates. In contrast, when the molecular weight is too high, the fixability of the toner deteriorates. In addition, the productivity of the toner deteriorates, specifically, the efficiency in a granulation process or a pulverization process deteriorates.

The number average molecular weight of the modified polyester resin (i) is not particularly limited if an unmodified polyester resin (ii) is used in combination therewith. Specifically, the weight average molecular weight of the modified polyester resin is mainly controlled rather than the number average molecular weight. When the modified polyester resin is used alone, the number average molecular weight of the resin is preferably not greater than 20,000, preferably from 1,000 to 10,000, and more preferably from 2,000 to 8,000. When the number average molecular weight is too high, the low temperature fixability of the resultant toner deteriorates. In addition, when the toner is used as a color toner, the resultant toner has low glossiness.

The modified polyester resin (i) is prepared by subjecting a polyester prepolymer (A) to a crosslinking reaction and/or a molecular chain extension reaction using an amine (B). In this case, a reaction inhibitor can be used to control the molecular weight of the resultant modified polyester resin. Suitable materials for use as the reaction inhibitor include monoamines such as diethyl amine, dibutyl amine, butyl amine and lauryl amine, and blocked amines of the monoamines such as ketimine compounds.

(Unmodified Polyester)

In the present invention, it is preferable to use a combination of a modified polyester resin (i) with an unmodified polyester resin (ii) as the binder resin of the toner. By using such a combination, the low temperature fixability of the toner can be improved and in addition the toner can produce color images having a high glossiness.

Suitable materials for use as the unmodified polyester resin (ii) include polycondensation products of a polyol (PO) with a polycarboxylic acid (PC). Specific examples of the polyol (PO) and polycarboxylic acid (PC) are mentioned above for use in the modified polyester resin (i). In addition, specific examples of the suitable polyol and polycarboxylic acid are also mentioned above.

In addition, polyester resins modified by a bonding (such as urethane bonding) other than a urea bonding are considered as the unmodified polyester resin (ii) in the present application.

When a combination of a modified polyester resin (i) with an unmodified polyester resin (ii) is used as the binder resin, it is preferable that the modified polyester resin is at least partially mixed with the unmodified polyester resin to improve the low temperature fixability and hot offset resistance of the toner. Namely, it is preferable that the modified polyester resin has a molecular structure similar to that of the unmodified polyester resin. The mixing ratio (i/ii) of a modified polyester resin (i) to an unmodified polyester resin (ii) is from 5/95 to 60/40, preferably from 5/95 to 30/70, more preferably from 5/95 to 25/75, and even more preferably from 7/93 to 20/80. When the added amount of the modified polyester resin is too small, the hot offset resistance of the toner deteriorates and in addition, it is impossible to achieve a good combination of high temperature preservability and low temperature fixability.

The peak molecular weight of the unmodified polyester resin (ii) is from 1,000 to 10,000, preferably from 2,000 to 8,000 and more preferably from 2,000 to 5,000. When the peak molecular weight is too low, the high temperature preservability of the toner deteriorates. In contrast, when the peak molecular weight is too high, the low temperature fixability of the toner deteriorates.

The unmodified polyester resin (ii) preferably has a hydroxyl value not less than 5 mgKOH/g, and more preferably from 10 to 120 mgKOH/g, and even more preferably from 20 to 80 mgKOH/g. When the hydroxyl value is too small, the resultant toner has poor high temperature preservability and poor low temperature fixability.

The unmodified polyester resin (i) preferably has an acid value of from 1 to 5 mgKOH/g, and more preferably from 2 to 4 mgKOH/g. When a wax having a high acid value is used as a release agent while a resin having a relatively low acid value is used as a binder resin, good charge properties and high volume resistivity can be imparted to the toner. The thus prepared toner can be preferably used for two component developers.

The binder resin for use in the toner preferably has a glass transition temperature (Tg) of from 35 to 70° C. and more preferably from 55 to 65° C. When the glass transition temperature is too low, the high temperature preservability of the toner deteriorates. In contrast, when the glass transition temperature is too high, the low temperature fixability deteriorates. When the toner of the present invention includes aurea-modified polyester resin and an unmodified polyester resin, the toner has relatively good preservability compared to conventional toners including a polyester resin as a binder resin even when the glass transition temperature of the toner of the present invention is lower than the polyester resin included in the conventional toners. This is because the urea-modified polyester resin is typically present on a surface of toner particles.

Colorant

The toner for use in the image forming apparatus of the present invention includes a colorant. Suitable materials for use as the colorant include known dyes and pigments.

Specific examples of the dyes and pigments include carbon black, Nigrosine dyes, black iron oxide, NAPHTHOL YELLOWS, HANSA YELLOW 10G, HANSA YELLOW 5G, HANSA YELLOW G, Cadmium Yellow, yellow iron oxide, loess, chrome yellow, Titan Yellow, polyazo yellow, Oil Yellow, HANSA YELLOW GR, HANSA YELLOW A, HANSA YELLOW RN, HANSA YELLOW R, PIGMENT YELLOW L, BENZIDINE YELLOW G, BENZIDINE YELLOW GR, PERMANENT YELLOW NCG, VULCAN FAST YELLOW 5G, VULCAN FAST YELLOW R, Tartrazine Lake, Quinoline Yellow LAKE, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED F2R, PERMANENT RED F4R, PERMANENT RED FRL, PERMANENT RED FRLL, PERMANENT RED F4RH, Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE RS, INDANTHRENE BLUE BC, Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

The content of the colorant in the toner is preferably from 1 to 15% by weight, and more preferably from 3 to 10% by weight of the toner.

Master batches, which are complexes of a colorant with a resin, can be used as the colorant of the toner for use in the present invention.

Specific examples of the resins for use as the binder resin of the master batches include polymers of styrene or styrene derivatives, copolymers of styrene with a vinyl monomer, polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These can be used alone or in combination.

Charge Controlling Agent

The toner for use in the image forming apparatus of the present invention preferably includes a charge controlling agent. Any known charge controlling agents can be used for the toner.

Suitable examples of the charge controlling agents include Nigrosine dyes, triphenyl methane dyes, chromium-containing metal complex dyes, molybdic acid chelate pigments, Rhodamine dyes, alkoxyamines, quaternary ammonium salts, fluorine-modified quaternary ammonium salts, alkylamides, phosphor and its compounds, tungsten and its compounds, fluorine-containing activators, metal salts of salicylic acid, metal salts of salicylic acid derivatives, etc. Among these materials, metal salts of salicylic acid and salicylic acid derivatives are preferably used. These materials can be used alone or in combination.

Specific examples of the marketed charge controlling agents include BONTRON® 03 (Nigrosine dye), BONTRON® P-51 (quaternary ammonium salt), BONTRON®S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPYBLUE® (triphenylmethane derivative), COPY CHARGE® NEG VP2036 and COPY CHARGE® NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments, and polymers having a functional group such as a sulfonate group, a carboxyl group, a quaternary ammonium group, etc.

The content of the charge controlling agent in the toner of the present invention is determined depending on the variables such as choice of binder resin, presence of additives, and dispersion method. In general, the content of the charge controlling agent is preferably from 0.1 to 10 parts by weight, and more preferably from 0.2 to 5 parts by weight, per 100 parts by weight of the binder resin included in the toner. When the content is too high, the charge quantity of the toner excessively increases, and thereby the electrostatic attraction between the developing roller and the toner increases, resulting in deterioration of fluidity and decrease of image density.

Release Agent

The toner for use in the image forming apparatus of the present invention can include a release agent. Suitable release agents include waxes having a melting point of from 50 to 120° C. When such a wax is included in the toner, the wax is dispersed in the binder resin and serves as a release agent while being present at a location between a fixing roller and the toner particles in the fixing process. Thereby the hot offset problem can be avoided without applying an oil to the fixing roller used.

Specific examples of the release agent include natural waxes such as vegetable waxes, e.g., carnauba wax, cotton wax, Japan wax and rice wax; animal waxes, e.g., bees wax and lanolin; mineral waxes, e.g., ozokelite and ceresine; and petroleum waxes, e.g., paraffin waxes, microcrystalline waxes and petrolatum. In addition, synthesized waxes can also be used. Specific examples of the synthesized waxes include synthesized hydrocarbon waxes such as Fischer-Tropsch waxes and polyethylene waxes; and synthesized waxes such as ester waxes, ketone waxes and ether waxes. Further, fatty acid amides such as 1,2-hydroxylstearic acid amide, stearic acid amide and phthalic anhydride imide; and low molecular weight crystalline polymers such as acrylic homopolymer and copolymers having a long alkyl group in their side chain, e.g., poly-n-stearyl methacrylate, poly-n-laurylmethacrylate and n-stearyl acrylate-ethyl methacrylate copolymers, can also be used.

The above-mentioned charge controlling agent and release agent can be kneaded with a master batch and a binder resin. Alternatively, the charge controlling agent and the release agent can be added to an organic solvent when the toner composition liquid is prepared.

External Additive

A particulate inorganic material is typically mixed with toner particles to assist in improving the fluidity, developing property and charging ability of the toner particles. It is preferable for the particulate inorganic materials to have a primary particle diameter of from 5 nm to 2 μm, and more preferably from 5 nm to 500 nm. In addition, it is preferable that the specific surface area of such particulate inorganic materials measured by a BET method is from 20 to 500 $m^2/g$. The content of the external additive is preferably from 0.01 to 5% by weight, and more preferably from 0.01 to 2.0% by weight, based on total weight of the toner composition.

Specific examples of such particulate inorganic materials include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

Among these particulate inorganic materials, a combination of a hydrophobic silica and a hydrophobic titanium oxide is preferably used. In particular, when a combination of a hydrophobic silica with a hydrophobic titanium oxide each having an average particle diameter not greater than 50 nm is used as an external additive, the electrostatic force and van der Waals' force between the external additive and the toner particles can be improved, and thereby the resultant toner has a proper charge quantity. In addition, even when the toner is agitated in a developing device, the external additive is hardly released from the toner particles, and thereby image defects such as white spots and image omissions are hardly produced. Further, the quantity of particles of the toner remaining on image bearing members can be reduced.

Titanium oxide exhibits high stability to withstand environmental conditions, and stably produce high density images. However, titanium oxide has a drawback in that the charge rising property of the toner deteriorates. Therefore it is not preferable that the content of titanium oxide is higher than that of silica. When the content of a hydrophobized titanium oxide is from 0.3 to 1.5% by weight, the charge rising property of the resultant toner hardly deteriorates. Therefore, images having good image qualities can be stably produced even when images are repeatedly produced.

Then the method for preparing the toner for use in the present invention will be explained.

(1) Preparation of Toner Composition Liquid

At first, a toner composition liquid is prepared by dissolving or dispersing toner constituents such as a colorant, an unmodified polyester resin, a prepolymer having an isocyanate group and a release agent in an organic solvent. The organic solvent is preferably a volatile solvent having a boiling point less than 100° C. so as to be easily removed from the resultant toner particles. Specific examples of such volatile solvents include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These solvents can be used alone or in combination. In particular, aromatic solvents such as toluene and xylene, and halogenated hydrocarbons such as methylene chloride, 1,2-dichloroethane, chloroform and carbon tetrachloride are preferably used.

The weight ratio of the solvent to the polyester prepolymer is generally from 0/100 to 300/100, preferably from 0/100 to 100/100 and more preferably from 25/100 to 70/100.

(2) Emulsification of the Toner Composition Liquid

The toner composition liquid is then dispersed in an aqueous medium in the presence of a surfactant and a particulate resin to prepare an emulsion. Suitable materials for use as the aqueous medium include water. In addition, organic solvents which can be mixed with water can be added to water. Specific examples of such solvents include alcohols such as methanol, isopropanol, and ethylene glycol; dimethylformamide, tetrahydrofuran, cellosolves such as methyl cellosolve, lower ketones such as acetone and methyl ethyl ketone, etc.

The weight ratio of the aqueous medium to the toner composition liquid is generally from 50/100 to 2,000/100 and preferably from 100/100 to 1,000/100. When the added amount of the aqueous medium is too low, the toner composition liquid cannot be well dispersed, and thereby toner particles having a desired particle diameter cannot be prepared. Adding a large amount of aqueous medium is not economical.

When the toner composition liquid is emulsified, a dispersant such as surfactants and particulate resins are preferably included in the aqueous medium.

Specific examples of the surfactants include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycin, di)octylaminoethyle)glycin, and N-alkyl-N,N-dimethylammonium betaine.

By using a fluorine-containing surfactant as the surfactant, good effects can be produced even when the added amount is small.

Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl (C6-C11)oxy}-1-alkyl(C3-C4) sulfonate, sodium 3-{omega-fluoroalkanoyl(C6-C8)-N-ethylamino}-1-propanesulfo nate, fluoroalkyl(C11-C20) carboxylic acids and their metal salts, perfluoroalkyl(C7-C13) carboxylic acids and their metal salts, perfluoroalkyl(C4-C12) sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonylglycin, monoperfluoroalkyl(C6-C16)ethylphosphates, etc.

Specific examples of the marketed products of such surfactants include SARFRON® S-111, S-112 and S-113, which are manufactured by Asahi Glass Co., Ltd.; FLUORAD® FC-93, FC-95, FC-98 and FC-129, which are manufactured by Sumitomo 3M Ltd.; UNIDYNE® DS-101 and DS-102, which are manufactured by Daikin Industries, Ltd.; MEGAFACE® F-110, F-120, F-113, F-191, F-812 and F-833 which are manufactured by Dainippon Ink and Chemicals, Inc.; ECTOP® EF-102, 103, 104, 105, 112, 123A, 306A, 501, 201 and 204, which are manufactured by Tohchem Products Co., Ltd.; FUTARGENT® F-100 and F150 manufactured by Neos; etc.

Specific examples of the cationic surfactants having a fluoroalkyl group, which can disperse an oil phase including toner constituents in water, include primary, secondary and tertiary aliphatic amines having a fluoroalkyl group, aliphatic quaternary ammonium salts such as perfluoroalkyl(C6-C10)sulfoneamidepropyltrimethylammonium salts, benzalkonium salts, benzetonium chloride, pyridinium salts, imidazolinium salts, etc. Specific examples of the marketed products thereof include SARFRON® S-121 (from Asahi Glass Co., Ltd.); FLUORAD®FC-135 (from Sumitomo 3M Ltd.); UNIDYNE® DS-202 (from Daikin Industries, Ltd.); MEGAFACE® F-150 and F-824 (from Dainippon Ink and Chemicals, Inc.); ECTOP® EF-132 (from Tohchem Products Co., Ltd.); FUTARGENT® F-300 (from Neos); etc.

Particulate resins are added to the aqueous medium to stabilize the toner particles which are prepared in the aqueous medium. Any known resins which can form an aqueous dispersion can be used as the particulate resin. Specific examples of the resins include thermoplastic resins and thermosetting resins such as vinyl resins, polyurethane resins, epoxy resins, polyester resins, polyamide resins, polyimide resins, silicone resins, phenolic resins, melamine resins, urea resins, aniline resins, ionomer resins, polycarbonate resins, etc. These resins can be used alone or in combination.

Among these resins, vinyl resins, polyurethane resins, epoxy resins, polyester resins and combinations thereof are preferably used because a resin dispersion including fine resin particles can be easily obtained. Suitable vinyl resins for use as the particulate resin include homopolymers and copolymers of vinyl monomers. Specific examples of the vinyl resins include styrene-(meth)acrylate copolymers, styrene-butadiene copolymers, (meth)acrylic acid-arylate copolymers, styrene-acrylonitrile copolymers, styrene-maleic anhydride copolymers, styrene-(meth)acrylic acid copolymers, etc. The average particle diameter of the particulate resins is preferably from 5 to 200 nm, and more preferably from 20 to 300 nm.

In addition, inorganic compounds can be used as a dispersant. Specific examples of the inorganic compounds include tricalcium phosphate, calcium carbonate, titanium oxide, colloidal silica, and hydroxyapatite can be preferably used.

Further, it is preferable to stabilize the emulsion or dispersion using a polymer protection colloid in combination with the particulate resins and inorganic dispersants.

Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine).

In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

Known dispersing machines can be used for emulsifying the toner composition liquid in an aqueous medium. Suitable dispersing machines include low speed shearing dispersion machines, high speed shearing dispersion machines, friction dispersion machines, high pressure jet dispersion machines, ultrasonic dispersion machines, etc.

When high speed shearing dispersion machines are used, the rotation number of the rotor is not particularly limited, but the rotation number is generally from 1,000 to 30,000 rpm, and preferably from 5,000 to 20,000. The dispersion time is not particularly limited. When a batch dispersion machines are used, the dispersion time is generally from 0.1 to 5 minutes. The dispersion temperature is preferably from 0 to 150° C. and preferably from 40 to 98° C.

(3) Reaction of Polyester Prepolymer (A) with Amine (B)

When the toner composition liquid is added in an aqueous medium to prepare an emulsion, an amine is added to the mixture to react the amine with the polyester prepolymer having an isocyanate group. The reaction is accompanied with crosslinking and/or extension of the molecular chains of the prepolymer. The reaction time is determined depending on the reactivity of the isocyanate group of the polyester prepolymer with the amine used, and is generally from 10 minutes to 40 hours, and preferably from 2 to 24 hours. The reaction temperature is generally from 0 to 150° C., and preferably from 40 to 98° C.

In addition, known catalysts such as dibutyltin laurate and tioctyltin layrate can be used, if desired, for the reaction.

(4) Removal of Organic Solvent and Washing and Drying

After the reaction, the organic solvent is removed from the emulsion (i.e., the reaction product), followed by washing and drying. Thus, toner particles are prepared. In order to remove the organic solvent, the emulsion is gradually heated while the emulsion is agitated so as to have a laminar flow. In this case, it is preferable to remove the solvent in a certain temperature range while strongly agitating the emulsion, so that the resultant toner particles have a spindle form. When a dispersant, which can be dissolved in an acid or an alkali, such as calcium phosphate is used, it is preferable to dissolve the dispersant with hydrochloric acid to remove that from the toner particles, followed by washing. In addition, it is possible to remove such a dispersant by decomposing the dispersant using an enzyme.

(5) Addition of External Additive

Then a charge controlling agent is fixed on the thus prepared toner particles and an external additive such as particulate inorganic materials (e.g., silica and titanium oxide) is added thereto. If desired, a particulate lubricant can also be added thereto. These materials can be added by a method using a known mixer or the like.

By using such a method, a toner having a small particle diameter and a sharp particle diameter distribution can be easily prepared. By controlling the agitation during the solvent removing operation, the particle form of the toner can be easily changed from spherical forms to rugby-ball forms. In addition, the surface conditions of the toner particles can be controlled so as to have a surface of from smooth surface to rough surface like pickled plum.

When the thus prepared toner is used for the image forming apparatus of the present invention, the image forming apparatus can produce high quality images.

The toner for use in the present invention preferably has a first shape factor SF-1 of from 100 to 180 and a second shape factor SF-2 of from 100 to 180.

Figure 21A:
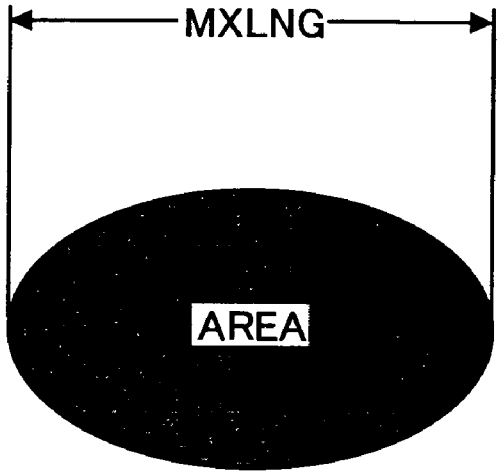
FIGS. 21A and 21B are schematic views for explaining the way to determine the shape factors SF-1 and SF-2.
Figure 21B:
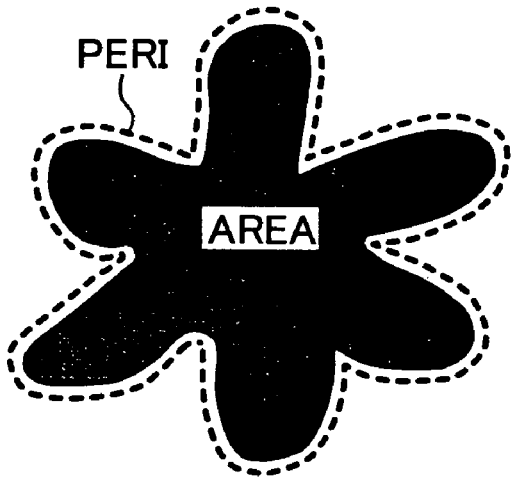

FIGS. 21A and 21B are schematic views for explaining the first and second shape factors SF-1 and SF-2, respectively.

As illustrated in FIG. 21A, the first shape factor SF-1 represents the degree of the roundness of a toner and is defined by the following equation (1):

$$SF\text{-}1=\{(MXLNG)^2/(\mathrm{AREA})\}\times(100\pi/4) \quad (1)$$

wherein MXLNG represents a diameter of the circle circumscribing the image of a toner particle, which image is obtained by observing the toner particle with a microscope; and AREA represents the area of the image.

When the SF-1 is 100, the toner particle has a true spherical form. In this case, the toner particles contact the other toner particles and the photoreceptor serving as an image bearing member at one point. Therefore, the adhesion of the toner particles to the other toner particles and the photoreceptor decreases, resulting in increase of the fluidity of the toner particles and the transferability of the toner. When the SF-1 is too large, the toner particles have irregular forms and thereby the toner has poor developability and poor transferability.

As illustrated in FIG. 21B, the second shape factor SF-2 represents the degree of the concavity and convexity of a toner particle, and is defined by the following equation (2):

$$SF\text{-}2=\{(PERI)^2/(\mathrm{AREA})\}\times(100/4\pi) \quad (2)$$

wherein PERI represents the peripheral length of the image of a toner particle observed by a microscope; and AREA represents the area of the image.

When the SF-2 approaches 100, the toner particles have a smooth surface (i.e., the toner has few concavity and convexity) It is preferable for a toner to have a slightly roughened surface because the toner has good cleanability. However, when the SF-2 is too large (i.e., the toner particles are seriously roughened), a toner scattering problem in that toner particles are scattered around a toner image is caused, resulting in deterioration of the toner image qualities.

The shape factors SF-1 and SF-2 are determined by the following method:

(1) particles of a toner are photographed using a scanning electron microscope (S-800, manufactured by Hitachi Ltd.); and (2) photograph images of 100 toner particles are analyzed using an image analyzer (LUZEX 3 manufactured by Nireco Corp.) to determine the SF-1 and SF-2.

When toner particles have a near-spherical form, the toner particles make a point contact with other toner particles and the surface of the photoreceptor used and thereby the attraction between the toner particles is decreased, resulting in enhancement of the fluidity of the toner particles. In addition, since the attraction between the toner particles and the photoreceptor is also decreased, the toner transfer rate can be increased (i.e., the toner has good transferability). When the shape factors SF-1 and SF-2 are too large, the toner has poor transferability.

The thus prepared toner can produce high quality images while the toner can be manufactured at a low energy. However, the toner often causes a cleaning problem in that the toner particles remaining on a surface of an image bearing member (such as photoreceptors) cannot be removed therefrom by passing through the nip between the cleaning blade and the surface of the image bearing member. When the toner particles remaining on the surface of the image bearing member even after the cleaning process are adhered to a charging roller and a toner layer is formed thereon, the charging ability of the charging roller deteriorates.

Since the charging device of the present invention includes a cleaner having a low compression strain, the surface of the charging device is kept clean for a long period of time even when a spherical toner, which has a poor cleanability, is used. This is because the cleaner can securely remove toner particles remaining on the charging member.

In addition, since the image forming apparatus of the present invention includes such a process cartridge as mentioned above, the image forming apparatus can stably produce high quality images for a long period of time.

This document claims priority and contains subject matter related to Japanese Patent Application No. 2004-281427, filed on Sep. 28, 2004, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A charging device comprising:

a charging member configured to charge an image bearing member of an image forming apparatus while the charging member is contacted with or is located so as to close to the image bearing member when the charging device is set in the image forming apparatus; and a cleaning member configured to clean a surface of the charging member while contacting the surface of the charging member, wherein the charging device satisfies the following relationship:

$$A>B,$$

wherein A represents a pressure at which the cleaning member is contacted with the charging member when the charging device is set in the image forming apparatus, and B represents a pressure at which the cleaning member is contacted with the charging member before the charging device is set in the image forming apparatus, wherein when the charging member is not set in the image forming apparatus, the cleaning member is pressed by a spring in a direction different from a direction toward a center of the charging member, and when the charging member is set in the image forming apparatus, the cleaning member is pressed by the spring toward the center of the charging member.

2. The charging device according to claim 1, further comprising:

a first pressing member configured to press the charging member to the image bearing member;

wherein the spring is configured to press the cleaning member to the charging member, and wherein the pressure B is maintained to be substantially constant by the spring.

3. The charging device according to claim 1, wherein the cleaning member is rotated while driven by the charging member.

4. The charging device according to claim 1, wherein the cleaning member comprises a material selected from the group consisting of foamed materials and fibrous materials.

5. A process cartridge comprising:

an image bearing member; and a charging device configured to charge a surface of the image bearing member, wherein the charging device is the charging device according to claim 1.

6. An image forming apparatus comprising:

an image bearing member;

a charging device configured to charge a surface of the image bearing member, wherein the charging device is the charging device according to claim 1;

a light irradiating device configured to irradiate the charged image bearing member with imagewise light to form an electrostatic latent image on the image bearing member;

a developing device configured to develop the electrostatic latent image with a developer including a toner to form a toner image on the image bearing member;

a transferring device configured to transfer the toner image to a receiving material; and a cleaning device configured to clean the surface of the image bearing member.

7. The image forming apparatus according to claim 6, wherein at least the image bearing member and the charging member are unitized as a process cartridge, and wherein the process cartridge is detachably attached to the image forming apparatus.

* * * * *